US009302863B1

(12) United States Patent
Piening et al.

(10) Patent No.: US 9,302,863 B1
(45) Date of Patent: Apr. 5, 2016

(54) SYSTEM AND METHOD FOR ADJUSTING A PICK HEIGHT OF A PICK MECHANISM IN AN IMAGE FORMING DEVICE

(71) Applicant: Lexmark International, Inc., Lexington, KY (US)

(72) Inventors: Chad Michael Piening, Lexington, KY (US); Brian Allen Blair, Richmond, KY (US); Curtis Duane Woodson, Georgetown, KY (US); Louann Behymer Samuels, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/686,172

(22) Filed: Apr. 14, 2015

(51) Int. Cl.

| | |
|---|---|
| ***B65H 1/14*** | (2006.01) |
| ***B65H 1/18*** | (2006.01) |
| ***B65H 3/06*** | (2006.01) |
| ***B65H 7/02*** | (2006.01) |
| ***B65H 1/04*** | (2006.01) |
| ***B65H 7/20*** | (2006.01) |

(52) U.S. Cl.
CPC .. *B65H 1/14* (2013.01); *B65H 1/04* (2013.01); *B65H 1/18* (2013.01); *B65H 3/0684* (2013.01); *B65H 7/02* (2013.01); *B65H 7/20* (2013.01)

(58) Field of Classification Search
CPC ..... B65H 1/14; B65H 1/18; B65H 3/0684; B65H 7/02; B65H 7/20; B65H 7/14
See application file for complete search history.

(56) References Cited

U.S. PATENT DOCUMENTS

| | | | | |
|---|---|---|---|---|
| 7,802,748 | B2 * | 9/2010 | De Matteis | B65H 19/2269 242/526.1 |
| 8,061,704 | B1 | 11/2011 | Blair et al. | |
| 8,123,212 | B1 | 2/2012 | Blair et al. | |
| 8,167,300 | B1 | 5/2012 | Blair et al. | |
| 8,573,587 | B2 * | 11/2013 | Yoshinaga | B65H 1/14 271/117 |

FOREIGN PATENT DOCUMENTS

JP 2006143346 A * 6/2006

* cited by examiner

*Primary Examiner* — Luis A Gonzalez
(74) *Attorney, Agent, or Firm* — John Victor Pezdek

(57) ABSTRACT

A method for adjusting a pick height of a pick mechanism includes determining a media type for a media stack. When the media type is a first media type, the lift plate is raised to raise the media stack and pick mechanism until a first light blocking region of a flag extending from the pick mechanism blocks an optical path of a sensor indicating that the pick mechanism has reached a first pick height. When the media type is a second media type, the lift plate is raised to raise the media stack and pick mechanism such that the first light blocking region first blocks the optical path, a first light passing region of the flag subsequently unblocks the optical path, and then a second light blocking region of the flag subsequently blocks the optical path indicating that the pick mechanism has reached a second pick height.

13 Claims, 18 Drawing Sheets

SYSTEM AND METHOD FOR ADJUSTING A PICK HEIGHT OF A PICK MECHANISM IN AN IMAGE FORMING DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The field relates generally to media input feed systems for an image forming device ("IFD") having a removable input tray, and, more particularly, to systems and methods for adjusting a pick height of a pick mechanism based on media type.

2. Description of the Related Art

IFDs, such as printers, scanners and photocopiers utilize media feed mechanisms for feeding various types of media sheets into the IFDs. Examples of the various types of media sheets include, but are not limited to, printing paper, bond paper, coated paper, fabrics, transparencies and labels. Almost all of the media feed mechanisms include a pick roller that feeds a media sheet into the IFD for further processing. In a media feed mechanism, various arrangements of the pick roller may exist for feeding the media sheet into the IFD.

Prior pick mechanisms were designed to swing down into the media tray and onto the media stack, and an elevator is used to lift the media stack up to the pick mechanism to raise the pick mechanism and adjust the pick height. The angle at which the pick mechanism contacts the media stack typically provides a corresponding normal force which is applied substantially perpendicular to the flat surface of the media sheet by the pick roller. The pick mechanism also includes a flag that is used in conjunction with a sensor to determine whether or not the pick mechanism is at a standard pick height. Typically, the flag actuates the sensor at a specific pick height location to indicate that the pick mechanism is at the standard pick height. This arrangement, however, has only one available pick height for all types of the media sheets.

As is known, media may have different densities, weights, thicknesses and stiffnesses such that the normal force required to feed one type of media into the IFD may need to be different from the normal force required to feed another type of media in order to avoid multiple feeds or misfeeds. For example, normal media, such as copy paper or bond paper, may be reliably fed by the pick mechanism at the standard pick height, but compressible media, such as envelopes or labels having RFID tags, may compress when picked at the same pick height and drop below the desired pick location due to the pick load from the pick mechanism. Further, the compression could push the compressible media down to pick against a vertical portion of a media dam or separator bracket which could cause a failure to feed. In another example, when heavier or stiffer media, such as cardstock, are picked at the same standard pick height, the leading edge of the heavier media strikes the separator system at a different angle than normal media and can tend to push out the media tray due to the separator system force applied to the stiffer media at that angle. Thus, having only one available pick height for all types of media sheets can result in difficulty with feeding certain media types, and in some cases cause failure to feed.

Accordingly, there is a need for an improved media feed system that can work reliably with different types of media.

SUMMARY OF THE INVENTION

Disclosed is a media feeding system for an IFD that can compensate for variations in media type by providing a pick mechanism that enables different pick heights for different media types. The media feeding system comprises an input media tray having a bottom with a raisable lift plate for holding a media stack of one or more media sheets, and a pick mechanism rotatably coupled to a drive assembly for feeding a topmost media sheet from the media stack. The pick mechanism includes a flag having a first and a second light blocking region, and a first light passing region therebetween. An optical sensor is mounted adjacent the input media tray. The optical sensor includes an emitter and a photo-receiver spaced to allow the flag to pass therebetween and provides an output signal that changes between a first state and a second state as the light blocking and light passing regions of the flag pass between the emitter and the photo-receiver, the output signal being representative of a position of the pick mechanism that changes as the height of the media stack changes. A lift mechanism is operably coupled to the lift plate for raising the lift plate, and a controller is operably coupled to the optical sensor, the drive assembly and the lift mechanism. The controller controls the lift mechanism to initialize the lift plate to a height in which the flag is positioned below the optical sensor and the output signal of the optical sensor is in the first state, and determines a media type for the stack of media sheets on the lift plate. When the media type determined is a first media type, the controller controls the lift mechanism to raise the lift plate to raise the stack of media sheets and the pick mechanism until the first light blocking region is positioned between the emitter and the photo-receiver changing the output signal from the first state to the second state indicating that the pick mechanism has reached a first pick height. When the media type determined is a second media type, the controller controls the lift mechanism to raise the lift plate to raise the stack of media sheets and the pick mechanism until the second light blocking region is positioned between the emitter and the photo-receiver changing the output signal from the first state to the second state back to the first state and then back to the second state indicating that the pick mechanism has reached a second pick height different from the first pick height.

Further disclosed is a method for adjusting a pick height of the pick mechanism which includes initializing a position of the flag to be below the optical sensor by controlling a height of the lift plate such that an optical path of the optical sensor is unobstructed by the flag arm and the signal output of the optical sensor is in a first state, and determining a media type for the media stack. When the media type determined is a first media type, the lift plate is raised to raise the media stack and the pick mechanism until the first light blocking region blocks the optical path of the optical sensor and changes the signal output from the first state to a second state indicating that the pick mechanism has reached a first pick height. When the media type determined is a second media type, the lift plate is raised to raise the media stack and the pick mechanism such that the first light blocking region first blocks the optical path and changes the signal output from the first state to the second state, the first light passing region subsequently unblocks the optical path and changes the signal output from the second state to the first state, and then the second light blocking region subsequently blocks the optical path and changes the signal output from the first state to the second state indicating that the pick mechanism has reached a second pick height different from the first pick height. When the media type determined is a third media type, the lift plate is raised to raise the media stack and the pick mechanism such that the first light blocking region first blocks the optical path and changes the signal output from the first state to the second state, and then the first light passing region subsequently unblocks the optical path and changes the signal output from the second state to the first state indicating that the pick mechanism has reached a third pick height between the first and second pick heights.

Additional light blocking and light passing regions may be provided in the flag to allow for additional pick heights for additional media types.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

FIGS. 14A-141 illustrate sequential actions of the index sensor as the pick mechanism, the media stack and the lift plate are raised.

DETAILED DESCRIPTION

Figure 1:
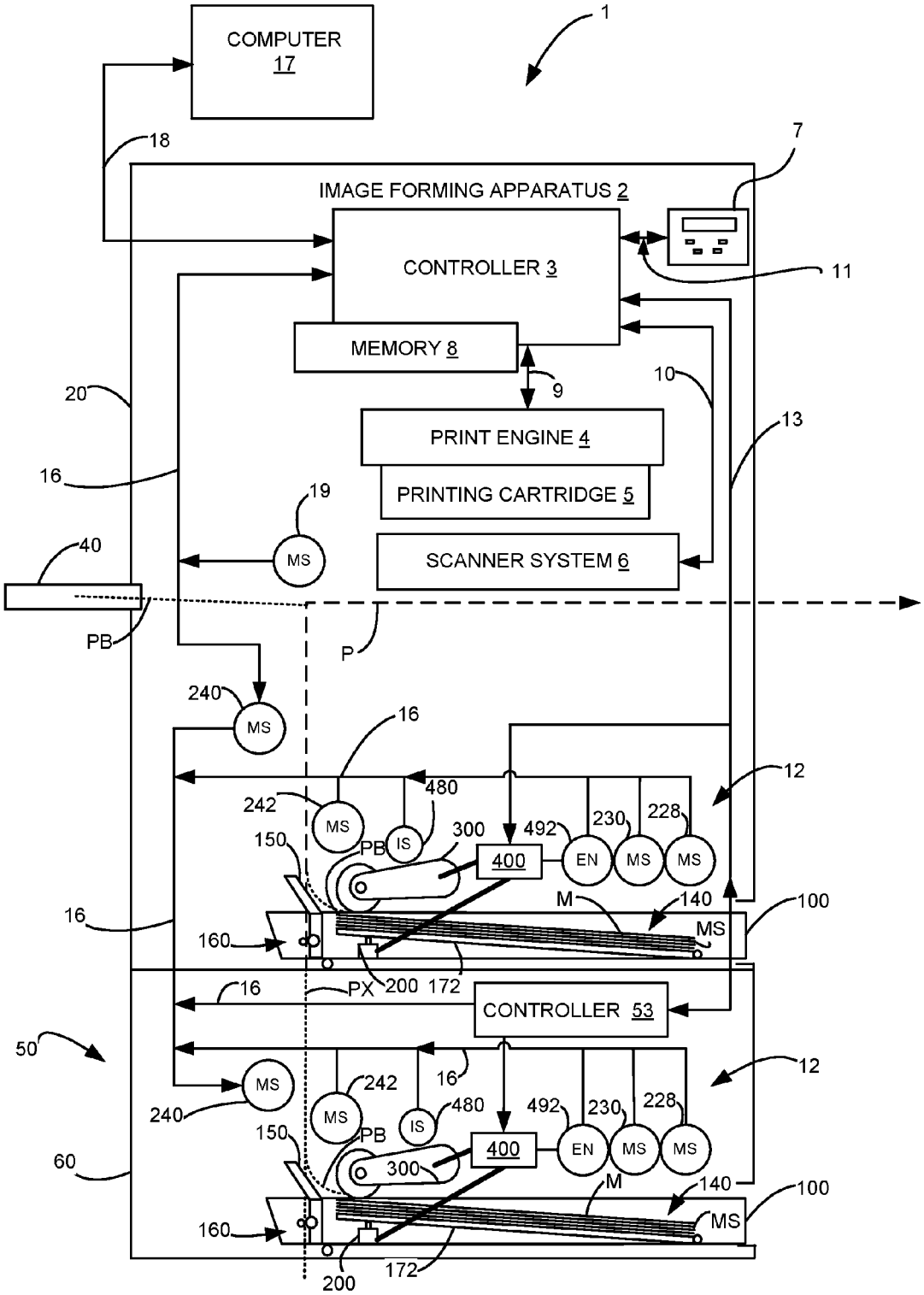
FIG. 1 is a schematic view of an imaging system according to one example embodiment.

It is to be understood that the present application is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this Detailed Description, would recognize that, in at least one embodiment, the electronic based aspects of the present disclosure may be implemented in software. As such, it should be noted that a plurality of hardware and software-based devices, as well as a plurality of different structural components may be utilized to implement the present disclosure. Furthermore, and as described in subsequent paragraphs, the specific mechanical configurations illustrated in the drawings are intended to exemplify embodiments of the present disclosure and other alternative mechanical configurations are possible.

It will be further understood that each block of the diagrams, and combinations of blocks in the diagrams, respectively, may be implemented by computer program instructions. These computer program instructions may be loaded onto a general purpose computer, special purpose computer, processor, or other programmable data processing apparatus to produce a machine, such that the instructions which execute on the computer or other programmable data processing apparatus may create means for implementing the functionality of each block or combinations of blocks in the diagrams discussed in detail in the descriptions below. These computer program instructions may also be stored in a non-transitory, tangible, computer readable storage medium that may direct a computer or other programmable data processing apparatus to function in a particular manner, such that the instructions stored in the computer readable storage medium may produce an article of manufacture including an instruction means that implements the function specified in the block or blocks. Computer readable storage medium includes, for example, disks, CD-ROMS, Flash ROMS, nonvolatile ROM and RAM. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus implement the functions specified in the block or blocks. Output of the computer program instructions may be displayed in a user interface or computer display of the computer or other programmable apparatus that implements the functions or the computer program instructions.

As used herein, the term "communication link" is used to generally refer to structure that facilitates electronic communication between multiple components, and may operate using wired or wireless technology. A communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11. While several communication links are shown, it is understood that a single communication link may serve the same functions as the multiple communication links that are illustrated.

The term "image" as used herein encompasses any printed or electronic form of text, graphics, or a combination thereof. "Media" or "media sheet" refers to a material that receives a printed image or, with a document to be scanned, a material containing a printed image. The media is said to move along the media path and the media path extensions from an upstream location to a downstream location as it moves from the media trays to the output area of the IFD. For each option tray, the top of the option tray is downstream from the bottom of the option tray. Conversely, the bottom of the option tray is upstream from the top of the option tray. Further, the media is conveyed using pairs of rolls that form nips therebetween. The term "nip" is used in the conventional sense to refer to a nip formed between two rolls that are located at about the same point in the media path and have a common point of tangency to the media path. Further relative positional terms are used herein. For example, "superior" means that an element is above another element. Conversely "inferior" means that an element is below or beneath another element. "Media process direction" describes the movement of media within the imaging system and is generally meant to be from an input toward an output of the imaging system. The explanations of these terms along with the use of the terms "top," "bottom," "front," "rear," "left," "right," "up," and "down" are made to aid in understanding the spatial relationship of the various components and are not intended to be limiting.

Figure 2:
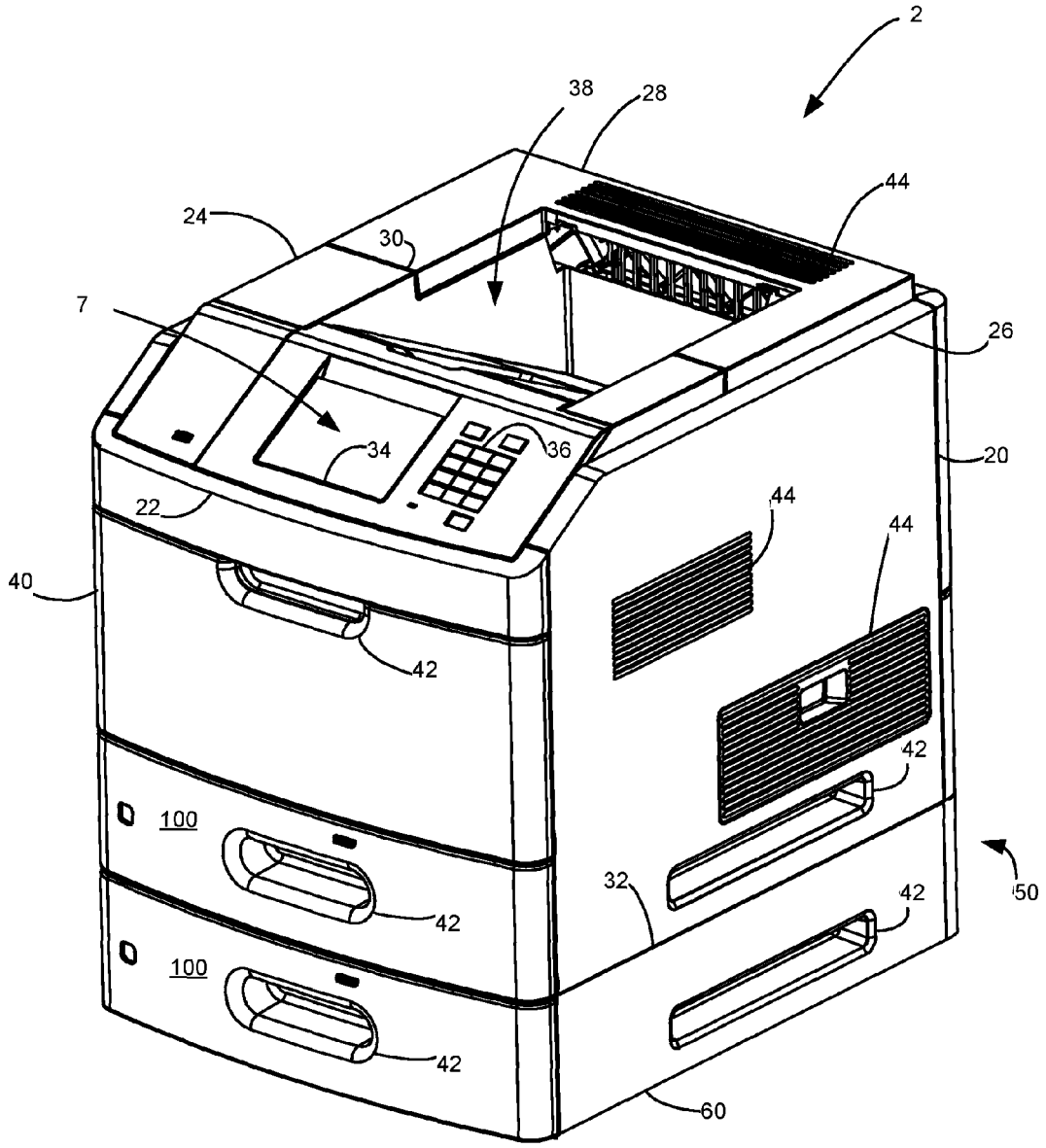
FIG. 2 is an illustration of an IFD with an option assembly according to one example embodiment.

Referring now to the drawings and particularly to FIGS. 1-2, there is shown a schematic depiction of an imaging system 1. As shown, imaging system 1 may include an IFD 2, an optional computer 17 and/or one or more option assemblies 50 attached to the IFD 2. IFD 2 is shown as a multifunction machine that includes a controller 3, a print engine 4, a printing cartridge 5, a scanner system 6, and a user interface 7. IFD 2 may also be configured to be a printer without scanning IFD 2 may communicate with computer 17 via communication link 18 using a standard communication protocol, such as for example, universal serial bus (USB), Ethernet or IEEE 802.xx. A multifunction machine is sometimes referred to in the art as an all-in-one (AIO) unit. Those skilled in the art will recognize that IFD 2 may be, for example, an ink jet printer/copier; an electrophotographic printer/copier; a thermal transfer printer/copier; other mechanisms including at least scanner system 6 or a standalone scanner system.

Controller 3 includes a processor unit and associated memory 8, and may be formed as one or more Application Specific Integrated Circuits (ASIC). Memory 8 may be any volatile or non-volatile memory of combination thereof such as, for example, random access memory (RAM), read only memory (ROM), flash memory and/or non-volatile RAM (NVRAM). Alternatively, memory 8 may be in the form of a separate electronic memory (e.g., RAM, ROM, and/or NVRAM), a hard drive, a CD or DVD drive, or any memory device convenient for use with controller 3. In one embodiment, controller 3 communicates with print engine 4 via a communication link 9. Controller 3 communicates with scanner system 6 via a communication link 10. User interface 7 is communicatively coupled to controller 3 via a communication link 11. User interface 7 may include firmware maintained in memory 8 which may be performed by controller 3 or another processing element. Controller 3 may be, for example, a combined printer and scanner controller. Controller 3 serves to process print data and to operate print engine 4 during printing, as well as to operate scanner system 6 and process data obtained via scanner system 6. Controller 3 may also be connected to computer 17 via communication link 18 where status indications and messages regarding the media and IFD 2 may be displayed and from which operating commands may be received. Computer 17 may be located nearby IFD 2 or remotely connected to IFD 2. In some circumstances, it may be desirable to operate IFD 2 in a standalone mode. In the standalone mode, IFD 2 is capable of functioning without a computer.

Controller 3 also communicates with a controller 53, via communication links 13 and 16, provided within each attached option assembly 50. Controller 53 operates various motors housed within option assembly 50 that position media for feeding, feed media from media path branches PB into media path P or media path extensions PX as well as feed media along media path extensions PX and media path P and control the travel of media along media path P and media path extensions PX.

IFD 2 and option assembly 50 each also include a media feed system 12 having a pick mechanism 300, a drive assembly 400 and removable media input tray 100 for holding a media stack MS containing one or more media sheets M to be printed. Media input tray also includes a media dam 150, a feed roll assembly 160, and a lift mechanism 200. In IFD 2, pick mechanism 300 and lift mechanism 200 are mechanically coupled to drive assembly 400 that is controlled by controller 3 via communication link 13. In option assembly 50, pick mechanism 300 and lift mechanism 200 are mechanically coupled to drive assembly 400 that is controlled by controller 3 via controller 53. In both IFD 2 and option assembly 50, pick mechanism 300 is used to drive a topmost media sheet M from the media stack MS into media dam 150 which directs the picked sheet into media path P or extension PX, and lift mechanism 200 is used to lower or raise a lift plate 172 and the media stack MS relative to pick mechanism 300. In IFD 2, media path P (shown in dashed line) is provided from the removable media input tray 100 extending through the print engine 4 and scanner system 6 to an output area 38 and to a duplexing path or to various finishing devices if provided. Media path P may also have extensions PX and/or branches PB (shown in dotted line) from or to other removable media input trays as described herein such as that shown in option assembly 50. Media path P may include a multipurpose input tray 40 and corresponding path branch PB that merges with the media path P within IFD 2. Along the media path P and its extensions PX are provided media sensors 240, 242 which are used to detect the position of the media sheet, usually the leading and trailing edges of the media sheet, as it moves along the media path P. Media type sensors 230 are provided in IFD 2 and each option assembly 50 to sense the type of media being fed from removable media input tray 100.

Media sensors 228 are provided in IFD 2 and each option assembly 50 to sense the size of media being feed from removable media input tray 100. Media sensors 240, 242 positioned along media path P and its extension PX and media sensors 230, 228 are shown in communication with controller 3 via communication link 16. Media sensor 240 senses a media sheet on media path P and extension PX while media sensor 242 senses a media sheet in path branch PB that is being picked from media storage area 140 of the internal removable media input tray 100. Downstream of removable media input tray 100 in IFD 2, a media sensor 19, communicatively coupled to controller 3 via communication link 16, is positioned along the media path P to sense the presence of, as well as, the leading and trailing edges of a media sheet being fed from multipurpose input tray 40, from removable media input tray 100 within IFD 2 and media being fed from option assembly 50.

FIG. 2 illustrates IFD 2 that includes the removable media input tray 100 that is integrated into a lower portion of the housing 20 of IFD 2. Housing 20 has a front 22, first and second sides 24, 26, rear 28, top 30 and bottom 32. User interface 7 comprising a display 34 and a key panel 36 may be located on the front 22 of housing 20. Using the user interface 7, a user is able to enter commands and generally control the operation of the IFD 2. For example, the user may enter commands to switch modes (e.g., color mode, monochrome mode), view the number of images printed, take the IFD 2 on/off line to perform periodic maintenance, and the like. A media output area 38 is provided in the top 30. Multipurpose media input tray 40 folds out from the front 22 of housing 20 which may be used for handling envelopes, index cards or other media for which only a small number of media will be printed. Hand grips 42 are provided in several locations on housing 20, such as on sides 24, 26, along the top of multipurpose media tray 40, and on the front of removable media input tray 100. Also various ventilation openings, such as vents 44 are provided at locations on first and second sides 24, 26 and top 30.

FIG. 2 also illustrates IFD 2 having an option assembly 50 comprising removable media input tray 100, a housing 60 in which removable media input tray 100, pick mechanism 300, and drive mechanism 400 are contained. IFD 2 sits on top of option assembly 50 forming a stack. Latches and alignment features are provided between adjacent units. An adjacent unit is either an IFD 2 or another option assembly 50. Additional option assemblies 50 may be added between the attached option assembly 50 or below it. As each option assembly 50 is added, an extension PX to the media path P is also added. The media path extension PX within each option assembly 50 is comprised of two branches which eventually merge at a point above their respective housing 60, either, depending on location within the stack, within a superior option assembly 50 or within IFD 2 itself.

Media sheets M are introduced from removable media input tray 100 and moved along the media path P and or a path extension PX during the image formation process. Each removable media input tray 100 is sized to contain a media stack MS of media sheets that will receive a color and/or monochrome image. Each removable media input tray 100 may have the same or similar features. Each removable media input tray 100 may be sized to hold the same number of media sheets or may be sized to hold different quantities of media sheets. In some instances, the removable media input tray 100 found in IFD 2 may hold a lesser, equal or greater quantity of media than a removable media input tray 100 found in an option assembly 50.

Figure 3:
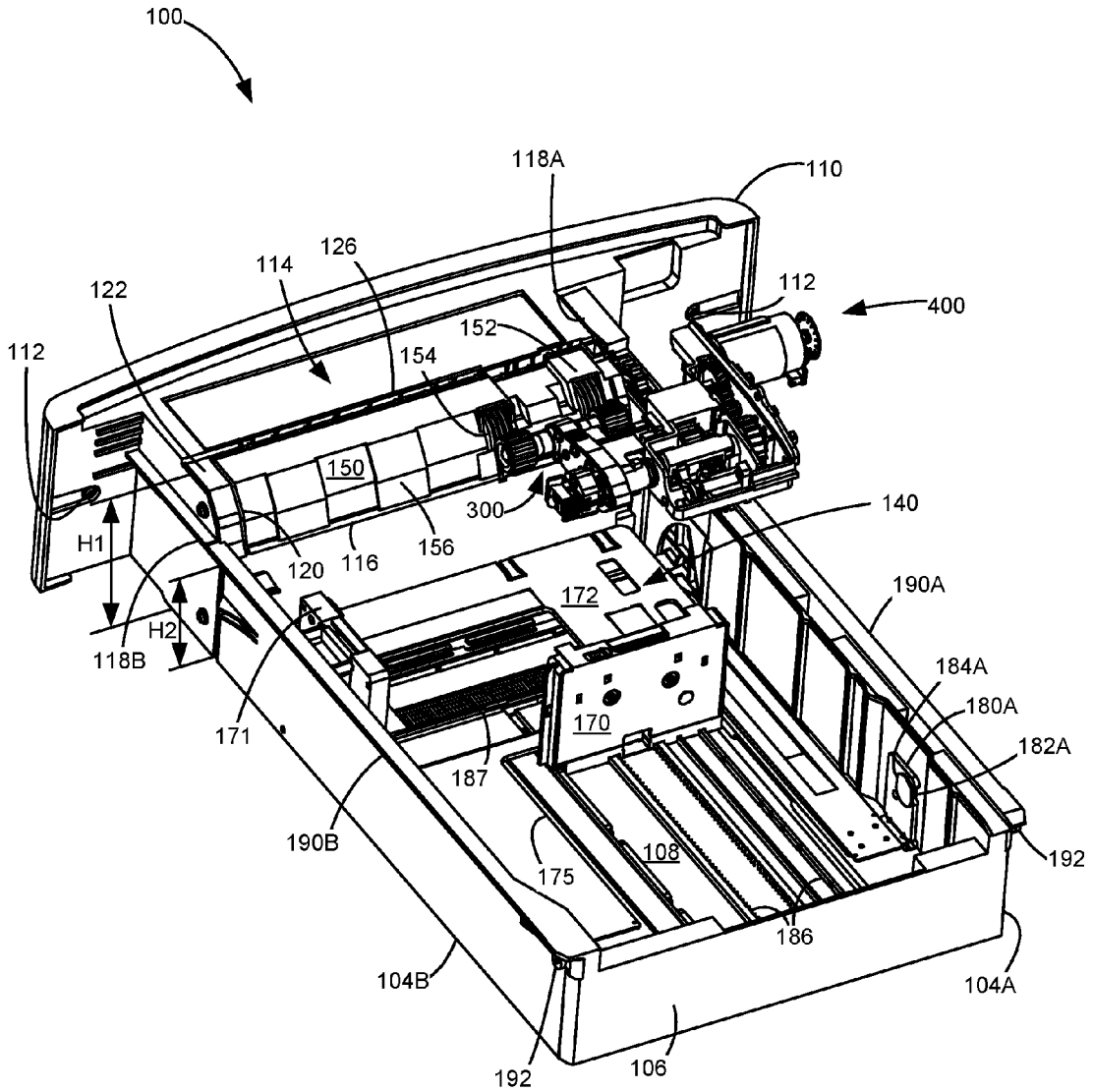
FIG. 3 is an illustration of a removable media input tray with a pick mechanism and drive system according to one example embodiment.
Figure 4:
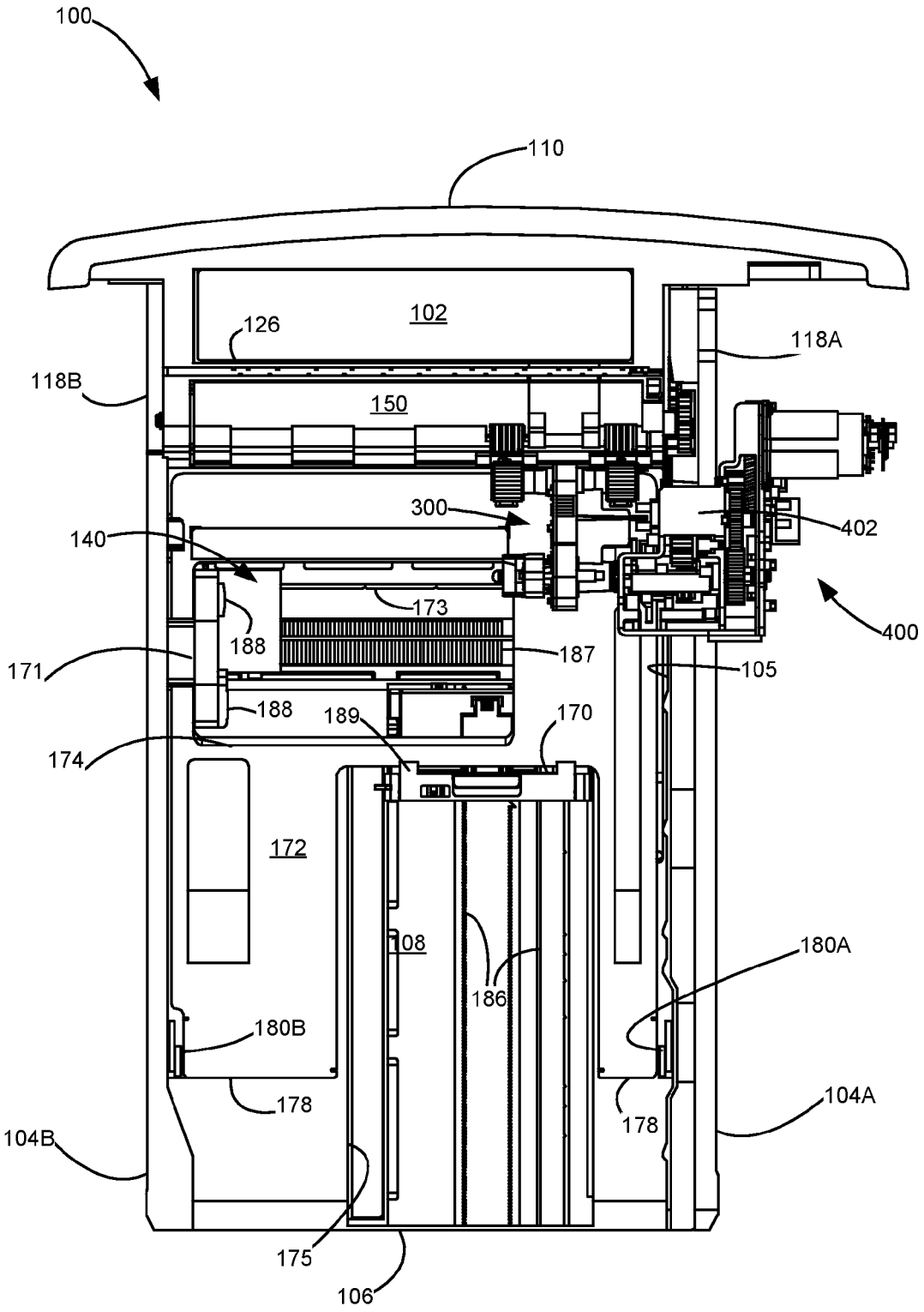
FIG. 4 is a top view of the removable media input tray, pick mechanism and drive system of FIG. 3.

Referring to FIGS. 3-4, removable media input tray 100 has a front wall 102, side walls 104A, 104B, a rear wall 106, and a bottom 108. Attached to a front surface of front wall 102 is panel 110 having hand grip 42 therein (See FIG. 2). Panel 110 is illustrated as being attached to front wall 102 by fasteners 112. Front wall 102 may be further defined by front portion 114 having a height H1, a rear portion 116 spaced apart from front portion 114 and having a height H2 that is less than height H1, with side portions 118A, 118B adjacent side walls 104A, 104B, respectively, connecting front and rear portions 114 and 116, and a top portion 122. Media dam 150 on front wall 102 contains a pair of spaced apart separator rollers 152 projecting through corresponding openings 154 in media contact surface 156. In other embodiments, a sloped media dam extends from the top of rear portion 116 to the top portion 122 of front wall 102 and between side portions 118A, 118B of front wall 102 and may be molded into the front wall 102. In either of these embodiments, media contact surface 156 forms an obtuse angle with the bottom 108. Also, the combination of rear portion 116 and media contact surface 156 may be referred to as a media dam having a vertical portion (rear portion 116) and an angled or sloped portion (media contact surface 156). In front of media dam 150, a channel 126 is provided to allow for a media sheet M to pass through removable media input tray 100 from an inferior unit to a superior unit.

Figure 5:
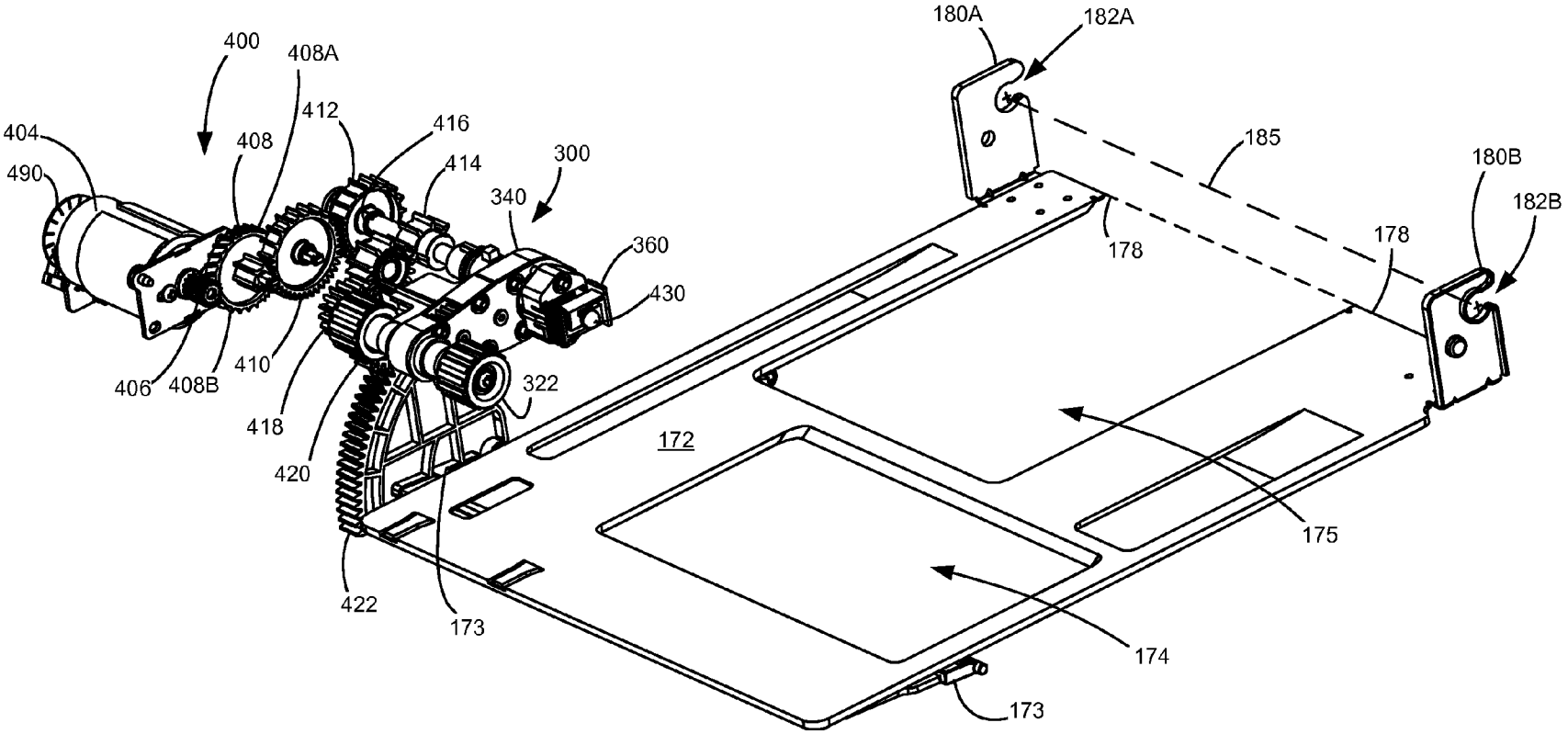
FIG. 5 is a perspective view of a drive mechanism connected to a lift plate according to one example embodiment.
Figure 6:
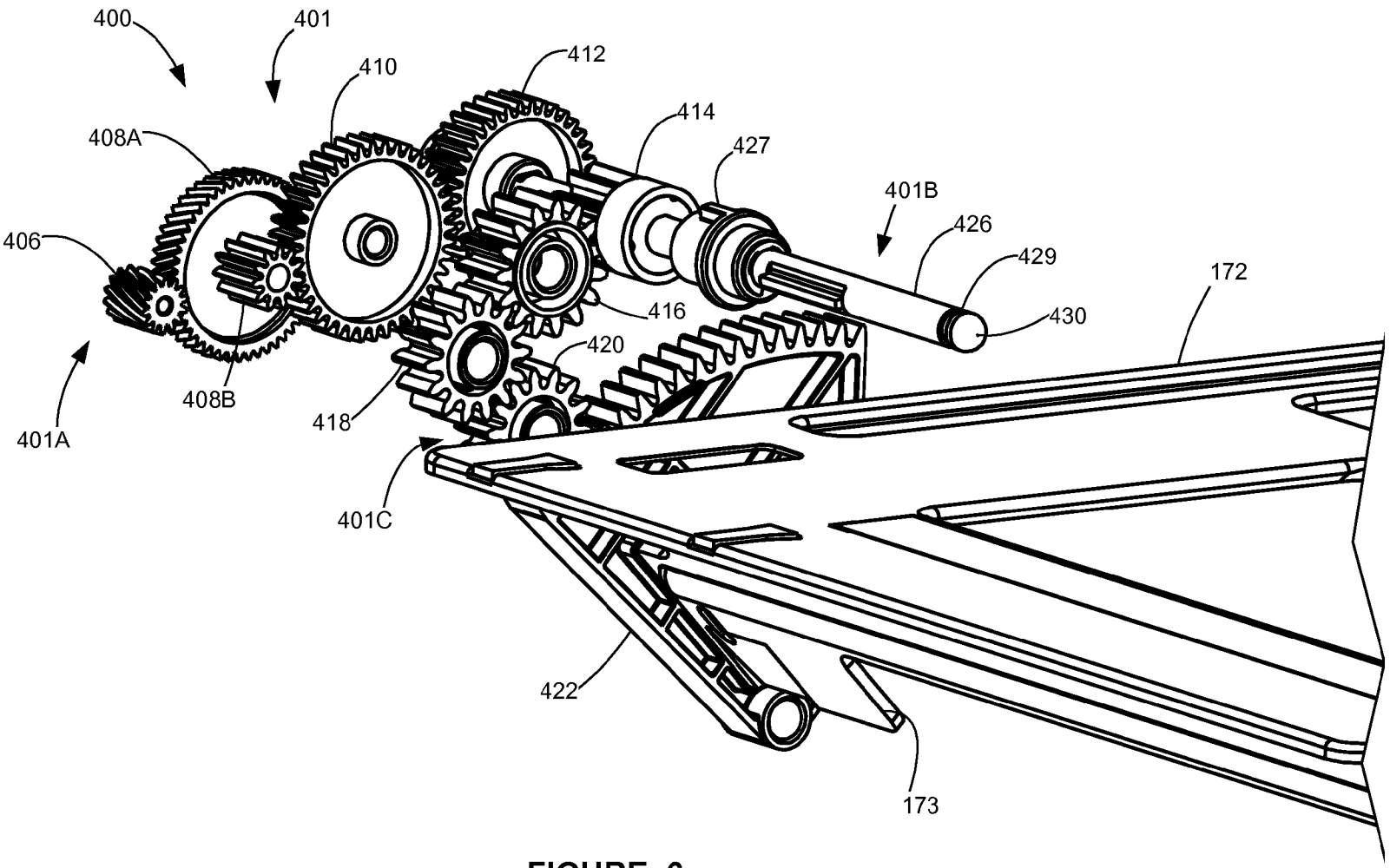
FIG. 6 is a perspective view of a drive transmission according to one example embodiment.
Figure 7:
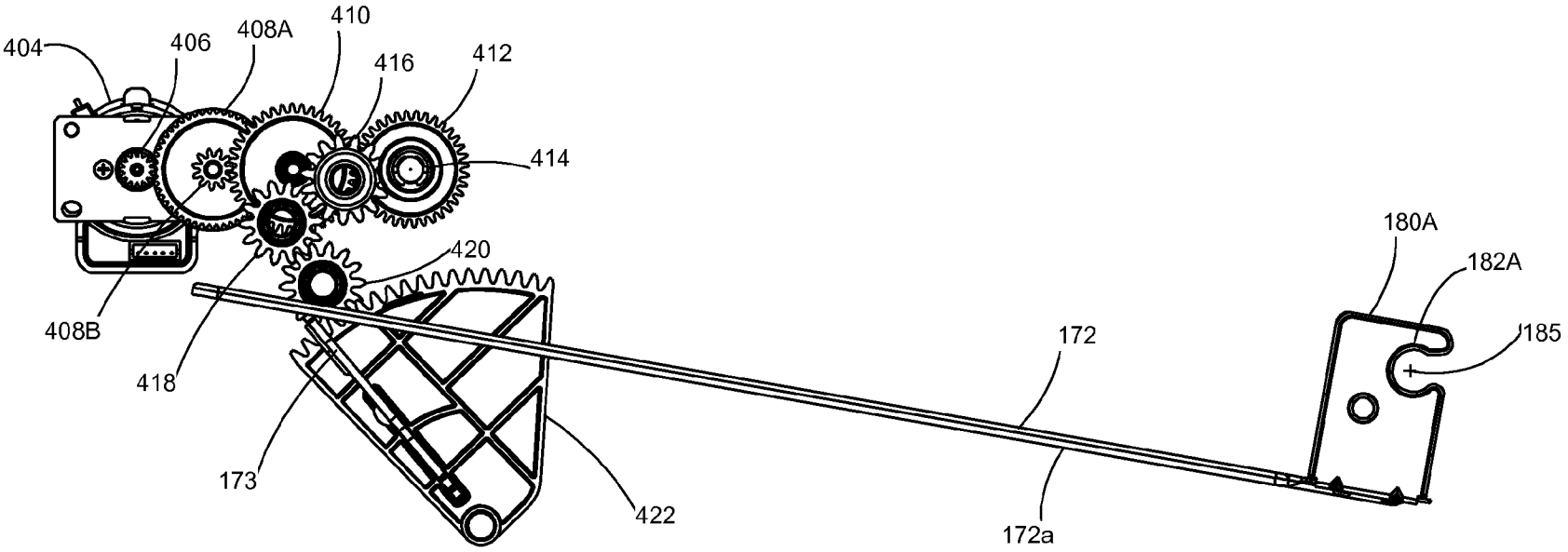
FIG. 7 is a side elevation view of the drive transmission in FIG. 6 according to one example embodiment.
Figure 8:
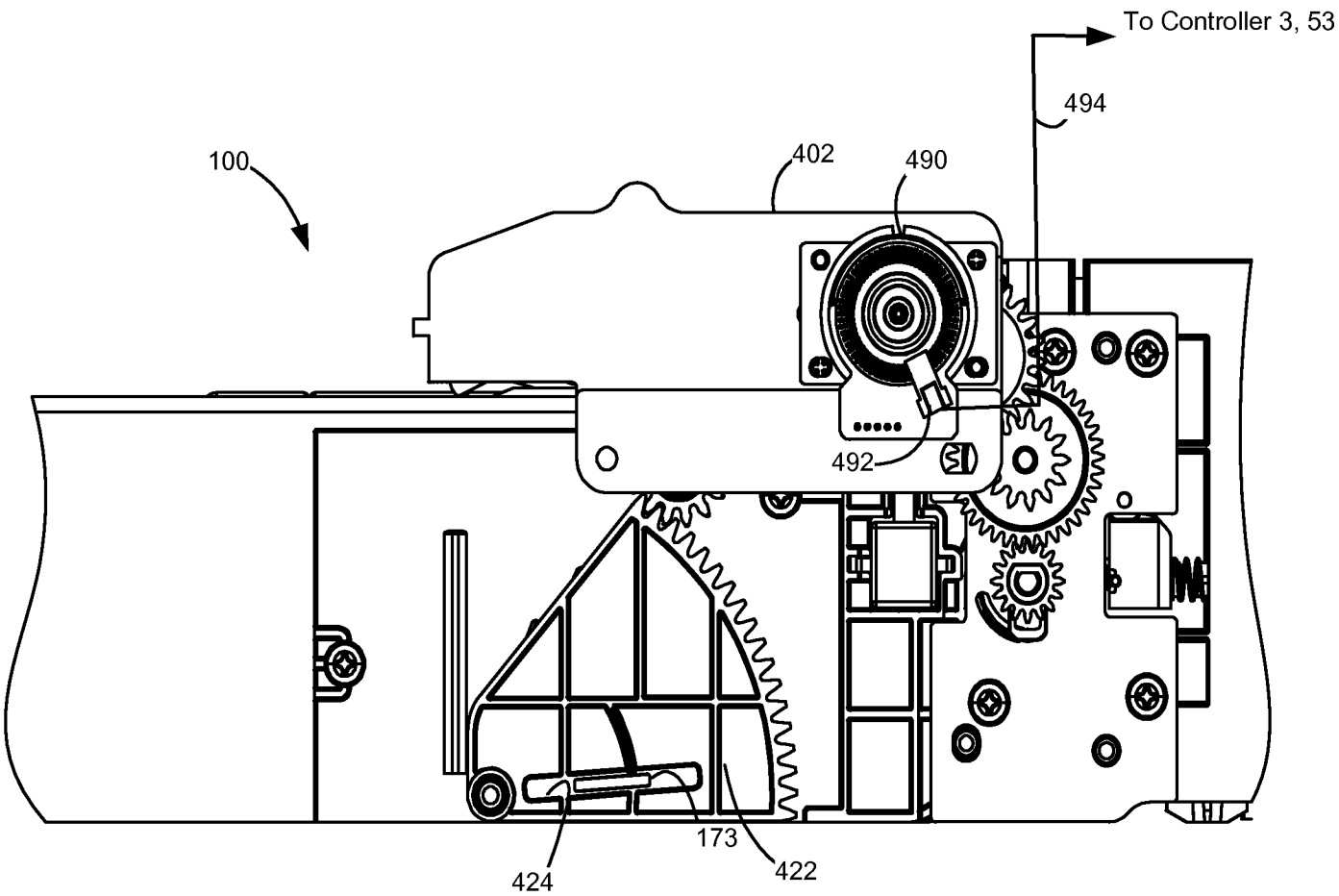
FIG. 8 is a side elevation view of a motor coupled to an encoder wheel according to one example embodiment.

Rearward of front wall 102 is media storage area 140 for media that will be fed to IFD 2 and is generally defined by front wall 102 and side walls 104A, 104B and bottom 108. As illustrated, rear wall 106 encloses media storage area 140. Alternate embodiments of removable media input tray 100 may not include a rear wall 106. Media storage area 140 may be open or enclosed. Within media storage area 140 are rear and side media restraints 170, 171, and lift plate 172. Media stack MS is placed on lift plate 172 which is positioned between side walls 104A, 104B and is dimensioned to hold the widest media for which removable media input tray 100 is designed to hold. As illustrated, the length of lift plate 172 is shorter than the length of the longest media for which removable media input tray is designed in that most media have a modicum of pliability. Example media sizes include, but are not limited to, A6, A4, A3, Letter, Legal, and Ledger. Openings 174, 175 are provided in lift plate 172 to accommodate the adjustment of rear and side media restraints 170, 171, which are slidably attached to bottom 108, while allowing lift plate 172 to be raised or lowered. Provided near the rear end 178 of the lift plate 172 are a pair of opposed pivot arms 180A, 180B that extend vertically upward from the lift plate 172 parallel to side walls 104A, 104B, respectively. Openings 182A, 182B are provided adjacent the upper ends of pivot arms 180A, 180B, respectively, which are received on corresponding bearing posts 184A, 184B provided on side walls 104A, 104B, respectively. The use of the pivot arms 180A, 180B raises a pivot axis 185 (see FIG. 5) of lift plate 172 from the bottom 108 to about the centerline of bearing posts 184A, 184B, a distance of about 30 mm. When media storage location 140 is at capacity, this places the leading edge of the top-most media proximate the top of rear portion 116. The location of axis 185 may be designed such that it would be approximately at the mid-point of the rated capacity for the removable media input tray 100. For example, if a filled removable media input tray 100 is designed to hold a media stack of about 50 mm in height, then pivot axis 185 would be located at about 25 mm from the top surface of lift plate 172. Raising pivot axis 185 of lift plate 172 reduces the amount of fanning or shingling that occurs in the leading edges of media sheets M in the media stack MS as it is raised up to pick mechanism 300 for feeding and provides near straight-line motion of the leading edges of the media sheets M. However other locations for the pivot axis 185 may also be used with media dam 150. In one example, the leading edge of lift plate 172 travels about 60 mm between its position on the bottom 108 of media input tray 100 to its highest position when it is empty of media sheets.

Media restraints 170, 171 are adjustable and lockable within tracks 186, 187 provided in bottom 108 to accommodate various lengths and widths of media in removable media input tray 100. Track 186 allows rear media restraint 170 to move from a distal position near rear wall 106 to a proximal position approximately midway along side walls 104A, 104B. Track 187 allows side media restraint 171 to laterally move from a position adjacent side wall 104B to a position approximately 80 mm from side wall 104A. This allows removable media input tray 100 to hold a narrow compressible media, such as envelopes, for feeding. Side media restraint 171 has at least one vertically extending media biasing member 188 to bias a topmost portion of the media toward a side wall 104A for aligning media to the media path P and media edge reference surface 105. Biasing member 188 may extend the height of side media restraint 171 or may extend only a portion of its height. Rear media restraint 170 has a spring-bias angled plate 189 that abuts the trailing edges of the media sheets M and angles or rotates outwardly from the bottom of rear media restraint 170 while pivoting about an axis near the top of angled plate 189. Angled plate 189 helps to reduce fanning or shingling of the leading edges of media sheets M of the media stack MS as it is elevated into picking position within housing 20 or housing 60 by applying greater biasing on the lower portion of the media stack MS in the media process direction than is applied at the top of angled plate 189.

Guide rails 190A, 190B are also provided on the side walls 104A, 104B, respectively, in addition to guide rollers 192 located on the distal end of side walls 104A, 104B near rear wall 106 to assist with insertion and removal of removable media input tray 100 from housing 20 or housing 60. For purposes of clarity, also shown in FIGS. 3-4 are pick mechanism 300 and drive mechanism 400 and their relation to removable media input tray 100 when installed in housing 60. As illustrated, pick mechanism 300 is connected to and supported by drive mechanism 400. A frame 402 mounted to housing 20 supports drive mechanism 400. Drive mechanism 400 is also provided in housing 60. Other mounting configurations for pick mechanism 300 may also be used.

With reference to FIGS. 5-8, drive mechanism 400 according to an example embodiment is shown. Drive mechanism 400 includes a motor 404 that drives pick mechanism 300 and lifts lift plate 172. Drive transmission 401 is shown having an input 401A connected to motor 404. Drive transmission 401 includes a first output 401B connected to pick mechanism 300 and a second output 401C connected to lift plate 172. While the example embodiment shown includes two outputs 401B, 401C, additional outputs may be provided as desired for performing additional functions.

A drive pinion 406 extends from motor 404 and connects to drive transmission 401 to transfer rotational force from motor 404 to drive transmission 401. In the example embodiment shown, drive pinion 406 is connected to a speed reducer dual gear 408 that includes a larger portion 408A and smaller portion 408B. Pinion 406 is connected to larger portion 408A while smaller portion 408B is connected to an intermediary gear 410. It will be appreciated that in this configuration, the rotational speed of intermediary gear 410 is less than the rotational speed of motor 404 and drive pinion 406 as a result of the difference between the circumferences of larger portion 408A and smaller portion 408B of speed reducer dual gear 408. Alternatives include those wherein the orientation of larger portion 408A and smaller portion 408B is reversed so that the rotational speed of intermediary gear 410 is greater than the rotational speed of motor 404 and drive pinion 406. Further alternatives include those wherein speed reducer dual gear 408 is replaced with a simple intermediary gear so that the rotational speed of intermediary gear 410 is the same as the rotational speed of motor 404 and drive pinion 406.

A pick mechanism drive gear 412 is connected to intermediary gear 410. A pick mechanism drive shaft 426 is substantially concentric with and extends from pick mechanism drive gear 412. Drive shaft 426 is positioned by a bearing sleeve 427 relative to frame 402. Bearing sleeve 427 is mounted in a hole in frame 402 and is disposed around drive shaft 426 so that drive shaft 426 is free to rotate. Drive shaft 426 extends from frame 402 in a cantilevered fashion and includes a free end 430. Pick mechanism 300 is removably mountable on free end 430 of drive shaft 426. When pick mechanism 300 is mounted on drive shaft 426, drive shaft 426 transfers rotational force to a drive transmission, such as a gear train, within transmission housing 340 for driving the pick wheels 322.

A first clutched gear 414 is connected to first output 401B of drive transmission 401. In the example embodiment shown, first clutched gear 414 is positioned around drive shaft 426. A second clutched gear 416 is connected to first clutched gear 414 and second output 401C of drive transmission 401. First and second clutched gears 414, 416 each include a one-way clutch. In the example embodiment shown, second clutched gear 416 is connected to an intermediary gear 418 protruding through top of the side wall 104A of the media input tray 100. Intermediary gear 418 is connected to a sector gear 422 pivotally mounted in side wall 104A. In the example embodiment illustrated, intermediary gear 418 is connected to sector gear 422 via an additional intermediary gear 420 in side wall 104A. A lift arm 173 is positioned beneath lift plate 172 and is connected to drive mechanism 400. Lift arm 173 extends through side wall 104A toward side wall 104B and is used to elevate lift plate 172 and media stack MS up to pick mechanism 300 for feeding media sheets M into media path P. Lift arm 173 is mounted to sector gear 422 through a radially oriented opening 424 in sector gear 422. Lift arm 173 is slidably disposed between bottom 108 and a bottom surface 172A of lift plate 172. Accordingly, rotation of sector gear 422 in one direction rotates lift arm upward against bottom surface 172A thereby rotating lift plate 172 about pivot axis 185.

The engagement of first clutched gear 414 is opposite the engagement of second clutched gear 416. Clutched gears 414, 416 are configured so that when pick mechanism 300 is driven in the media process direction for feeding media sheets M, lift plate 172 is held in place during feeding of media. When elevation of lift plate 172 is called for as media is removed during media feeding, motor 404 rotation is reversed raising lift plate 172 while reversing the rotation of pick mechanism 300 to be opposite the media process direction. In the example embodiment shown, when motor 404 drives the pick mechanism 300 in the media process direction, first clutched gear 414 is disengaged so that it does not rotate with drive shaft 426 and second clutched gear 416 is engaged to hold lift plate 172 in place. Pick mechanism 300 as illustrated may be rotated downward from the horizontal position through an arc of about 20 degrees with the nominal operating range being between 10 to 16 degrees. When motor 404 drives pick mechanism 300 opposite to the media process direction, first clutched gear 414 is engaged so that it rotates with drive shaft 426 as it is driven by motor 404 and second clutched gear 416 is disengaged and driven by first clutched gear 414 to rotate sector gear 422. Rotation of the sector gear 422 raises lift arm 173 and, in turn, raises lift plate 172.

Motor 404 includes an encoder wheel 490 that rotates with motor 404 providing encoder pulses indicative of the rotation of motor 404. As encoder wheel 490 rotates, an encoder wheel sensor 492 provides an output 494 in the form of pulses to controllers 3, 53 that allows controllers 3, 53 to track the rotation of encoder wheel 490 and motor 404 which may be used to track movement of lift plate 172 and rotation of pick mechanism 300.

Figure 9:
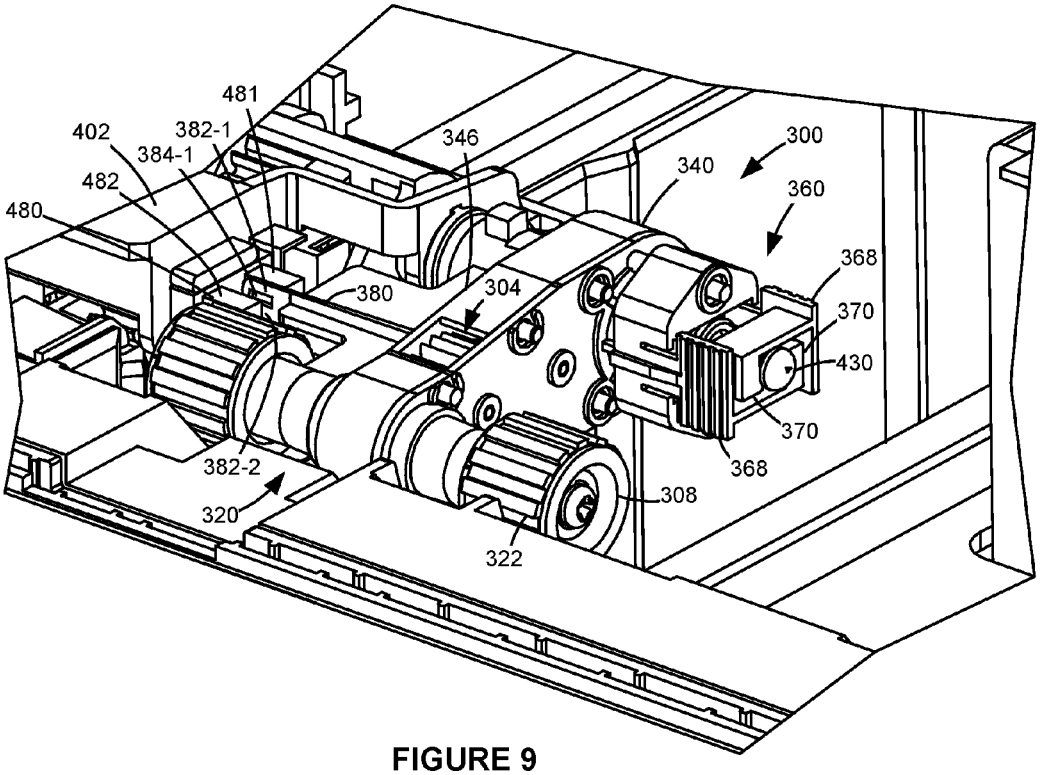
FIGS. 9-10 are left and right perspective views of the pick mechanism including a flag having two light blocking regions and a light passing region therebetween according to one example embodiment.
Figure 10:
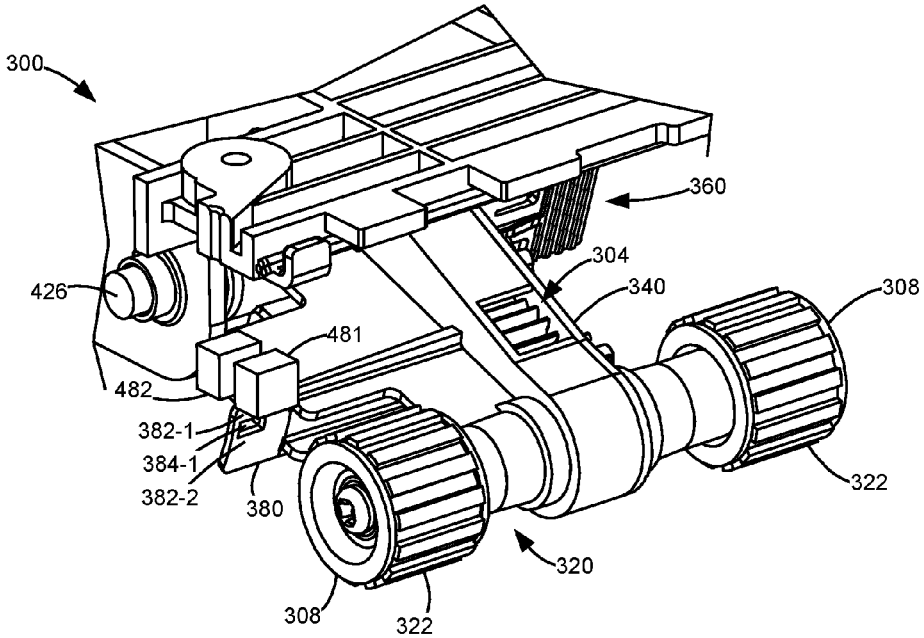

Referring to FIGS. 9-10, pick mechanism 300 is shown in further detail. Pick mechanism 300 comprises drive transmission 304, a pick axle assembly 320 and a transmission housing 340 for reversible drive transmission 304. Drive transmission 304 is at one end operatively connected to pick drive shaft 426 extending from drive mechanism 400 mounted on housing 20 of IFD 2 or housing 60 of option assembly 50. At its other end, drive transmission 304 is coupled to a pick axle assembly 320 having a pick wheel 308 mounted at each end. Other configurations of pick wheels may also be used. For example, a single pick wheel or three pick wheels may be mounted on pick axle assembly 320. In operation, when pick drive shaft 426 is rotated, torque is transferred through to drive transmission 304 to pick axle assembly 320 which drives pick wheels 308. A releasable latch 360 is mounted on the exterior of side 348 of transmission housing 340 and has an opening centered about the free end 430 of drive shaft 426 allowing latch 360 to be slid onto pick drive shaft 426. Latch 360 engages a circumferential groove 429 provided near free end 430 of drive shaft 426. Opposed resilient members 368 have ends 370 that engage with circumferential groove 429 and axially position pick mechanism 300 on pick drive shaft 426. Removal of pick mechanism 300 is accomplished by the user pressing resilient members 368 inwardly toward drive shaft 426 separating and releasing ends 370 from groove 429 and permitting pick mechanism 300 to be slid off drive shaft 426. When installing pick mechanism 300, a user simply slides pick mechanism 300 onto drive shaft 426. Free end 430, which in one embodiment is rounded, acts to separate ends 370 as pick mechanism 300 is slid into position on drive shaft 426. Ends 370 eventually snap into groove 429 to position pick mechanism 300 on pick drive shaft 426. The design and mounting of pick mechanism 300 should not be considered as a limitation of the present disclosure. Other types of pick mechanisms and mounting configurations may be used.

A flag 380 also extends outwardly from transmission housing 340 and is used to change the state of an index sensor 480 which is used for feeding media sheets M from removable media input tray 100. As illustrated, flag 380 extends outwardly from a side 346 of transmission housing 340. While latch 360 and flag 380 are shown as mounted on opposite sides of transmission housing 340, they can be mounted on the same side. Index sensor 480 is positioned on frame 402 adjacent to the drive shaft 426 and is in operable communication with controller 3, 53 via communication links 13, 16 and provides an output signal representative of a position of pick mechanism 300 that changes as the height of the media stack MS of media sheets M changes. In the example embodiment illustrated, index sensor 480 is an optical sensor having an optical path between a pair of opposed arms comprising an emitter 481, which emits optical energy along an optical path 483, and a photo-receiver 482, which receives optical energy from emitter 481, that are spaced to allow flag 380 to pass therebetween. However, any suitable sensor may be used. In operation, lift plate 172 is raised in indexed moves based on the output signal of index sensor 480 in order to ensure that the top of the media stack MS is within a desired pick height.

Figure 11:
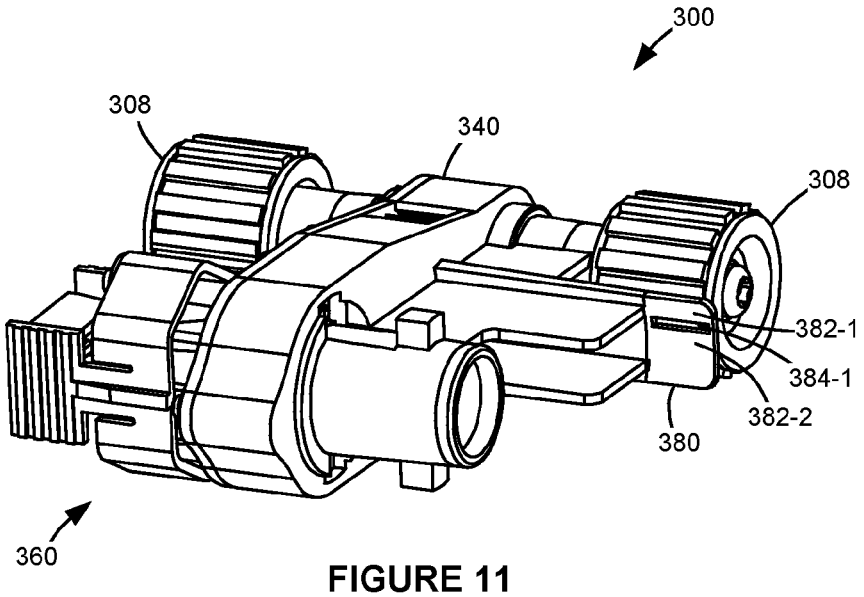
FIG. 11 is a rear view of the pick mechanism illustrated in FIGS. 9-10.
Figure 12:
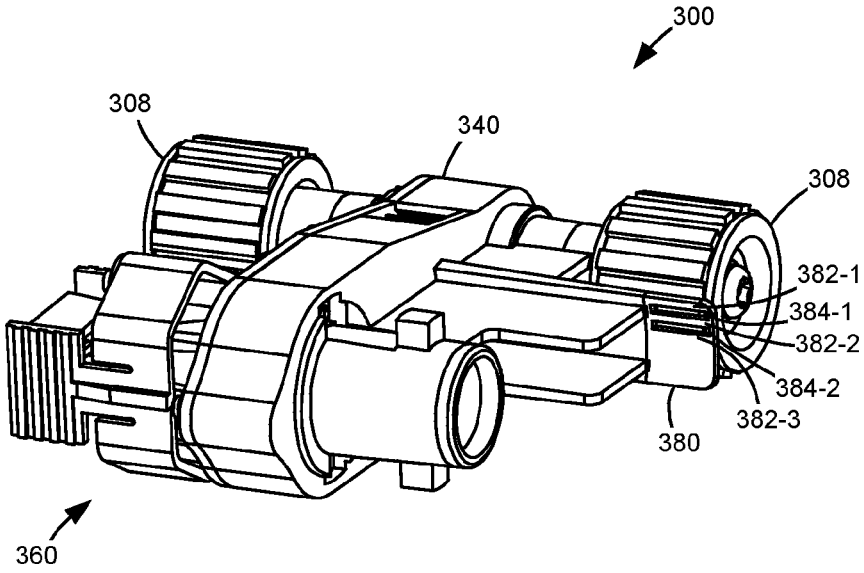
FIG. 12 is a view of the pick mechanism including a flag having three light blocking regions and two light passing regions according to one example embodiment.

In accordance with example embodiments of the present disclosure, flag 380 may include multiple light blocking regions separated therebetween by a light passing region, thereby forming an alternating pattern of light blocking and light passing regions that change the state of index sensor 480 between a first state and a second state as each region moves into the optical path as the position of pick mechanism 300 changes. In the example embodiments shown in FIGS. 9-11, flag 380 includes a first light blocking region 382-1 starting at the top of flag 380, a second light blocking region 382-2, and a first light passing region 384-1 therebetween. In the example embodiment illustrated in FIG. 12, flag 380 includes first and second light blocking regions 382-1, 382-2 separated therebetween by first light passing region 384-1, and a third light blocking region 382-3 separated from second light blocking region 382-2 by a second light passing region 384-2. In other example embodiments, the number of light blocking regions and light passing regions provided in flag 380 is a matter of design choice. Generally, the light blocking regions 382 and light passing regions 384 are used in adjusting the position of pick mechanism 300 to at least two different pick heights to accommodate different types of media sheets, as will be explained in greater detail below. Further, the number of light blocking regions 382 and light passing regions 384 may vary based on media feed performance for certain media types and the pick location that is needed.

In one example embodiment, light blocking regions 382-1-382-3 comprise opaque solid sections of flag 380 while light passing regions 384-1, 384-2 comprise openings or slots formed on flag 380. In an alternative example embodiment, flag 380 may be molded having transparent/translucent and opaque regions, with the opaque regions forming the light blocking regions and the transparent/translucent regions forming the light passing regions. In another alternative example embodiment, flag 380 may be provided as a translucent or transparent material and the light blocking regions 382-1-382-3 may be achieved by varying the opacity of portions of flag 380, such as by applying coatings or stickers to such portions of flag 380, and the remaining uncoated portions of flag 380 may form the light passing regions.

Figure 13:
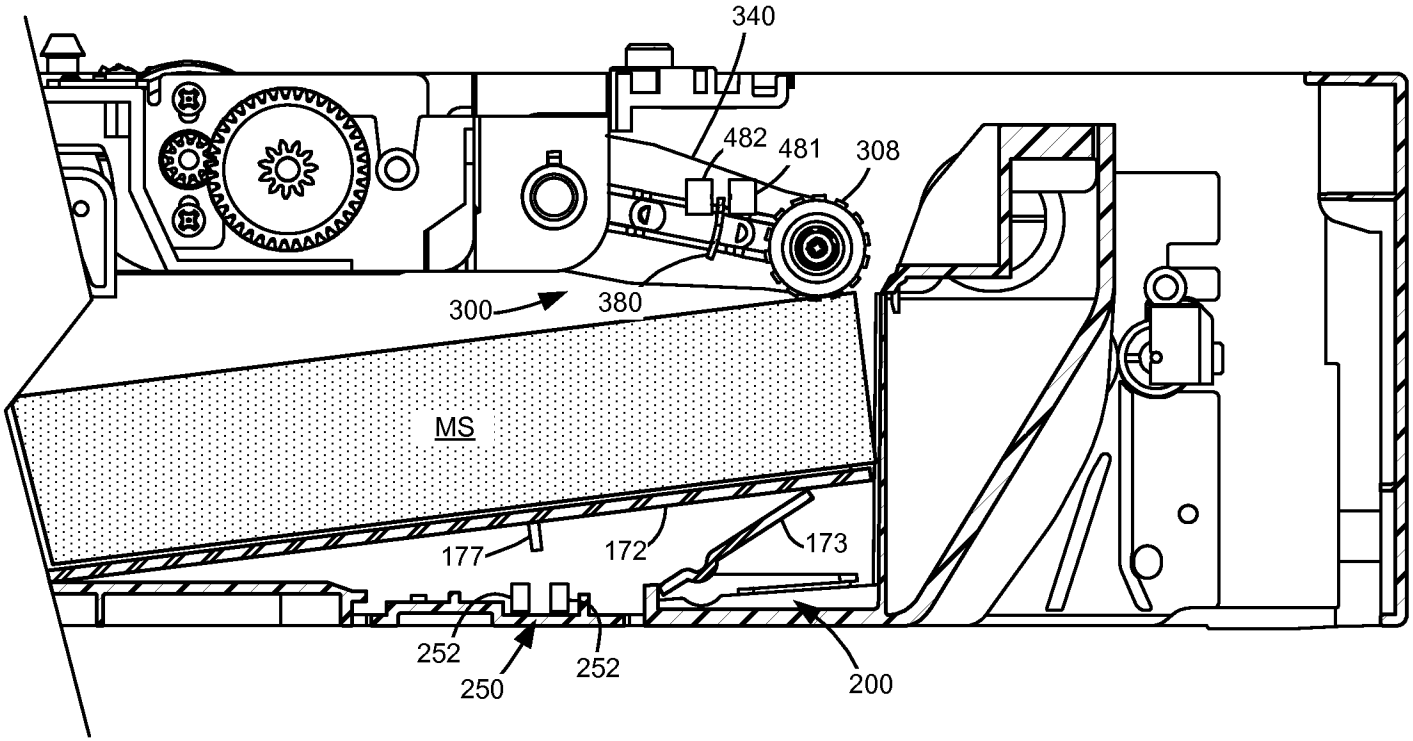
FIG. 13 is a section view of the removable media input tray illustrating a media stack elevated within a media storage location by a lift plate to contact the pick mechanism.

With reference to FIG. 13, in order to index lift plate 172, motor 404 drives pick mechanism 300 opposite the media process direction and raises lift arm 173, and in turn, raises lift plate 172, in order to raise the media stack MS. Initially, when removable media input trays 100 are inserted into housings 20, 60, lift plate 172 is initialized to a height in which flag 380 is positioned below index sensor 480 such that the optical path of index sensor 480 is unobstructed by flag 380 and the output signal of index sensor 480 is in the first state. As the lift plate 172 is raised and when the top of the media stack MS contacts the pick mechanism 300, the media stack MS pushes pick mechanism 300 up until flag 380 enters into and passes between opposed arms 481, 482 of index sensor 480, as illustrated in FIG. 13. When a light blocking region blocks the optical path of index sensor 480, the output signal of index sensor 480 is in the second state. Conversely, when a light passing region unblocks the optical path of index sensor 480, the output signal of index sensor 480 is in the first state. Thus, as flag 380 is raised continuously upward from its initial position below index sensor 480 and as the light blocking regions 382-1-382-3 and light passing regions 384-1, 384-2 sequentially pass between opposed arms 481, 482, the output signal of index sensor 480 has multiple transitions between the first state and the second state. In accordance with example embodiments of the present disclosure, the light blocking regions 382-1-382-3 and light passing regions 384-1, 384-2 which cause the output signal transitions to occur are used to indicate whether or not pick mechanism 300 has reached a desired pick height for picking media sheets of a particular type. As such, different regions of flag 380 can block and/or unblock index sensor 480 at multiple locations and enable different pick heights for pick mechanism 300 to accommodate different media types.

Figure 14A:
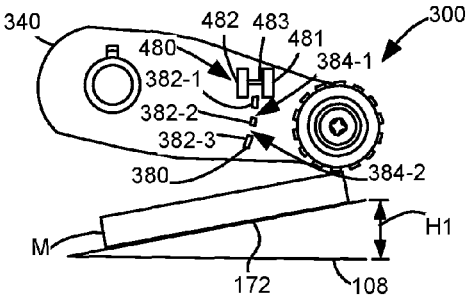
Figure 15:
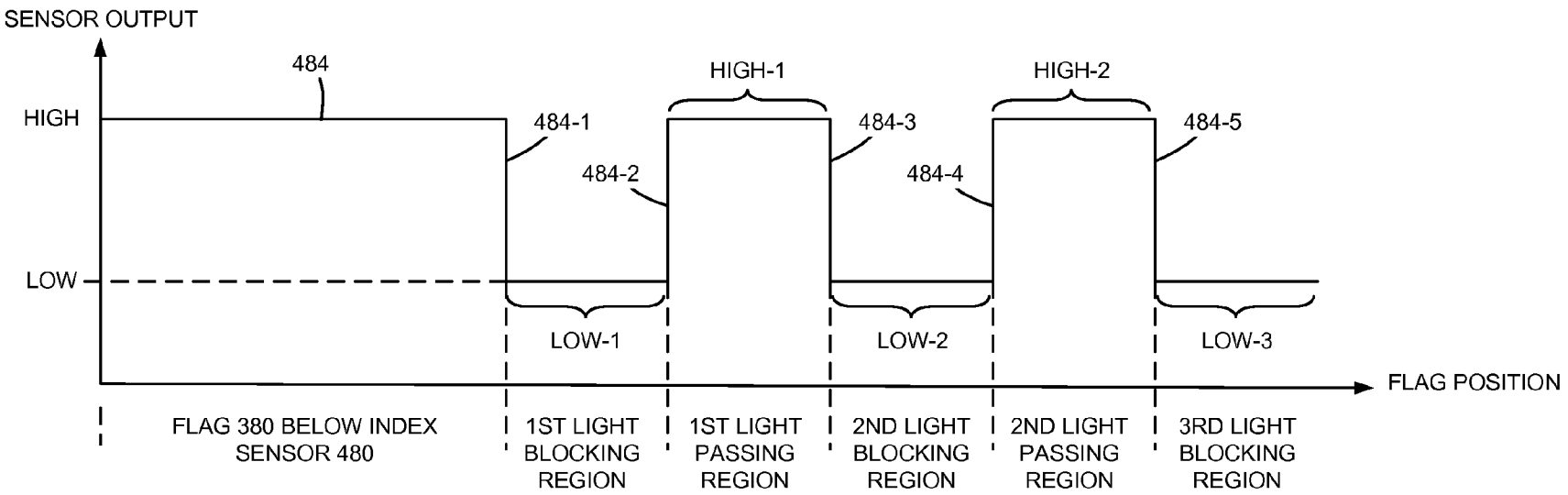
FIG. 15 illustrates a signal representation of the output of the index sensor as different regions of the flag move relative to the index sensor as the pick mechanism is raised.

Operation between flag 380 and index sensor 480 will now be described with reference to FIGS. 14A-141 illustrating sequential actions of pick mechanism 300 as lift plate 172 is raised by lift mechanism 200 from a height H1 to a height H9 and with flag 380 having three light blocking regions 382-1-382-3 and two light passing regions 384-1, 384-2; FIG. 15 showing an example output signal 484 of index sensor 480 as different regions of flag 380 move into and out of the optical path 483 of index sensor 480 as pick mechanism 300 is raised; and, FIG. 16 showing in more detail the three light blocking regions 382-1-383-3 and two light passing regions 384-1, 384-2 of flag 380 illustrated in FIGS. 14A-141 relative to the optical path 483 of index sensor 480.

Figure 16:
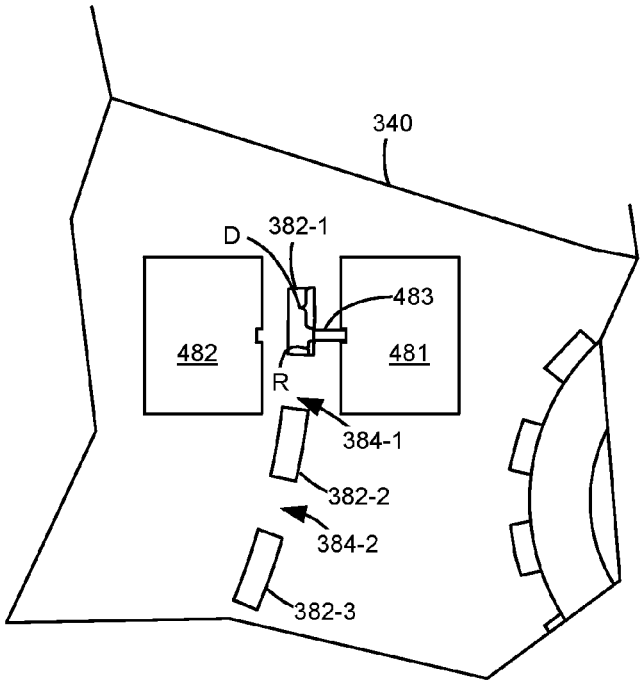
FIGS. 16-17 illustrate different positions of the pick mechanism with light blocking regions of the flag blocking an optical path of the index sensor.
Figure 17:
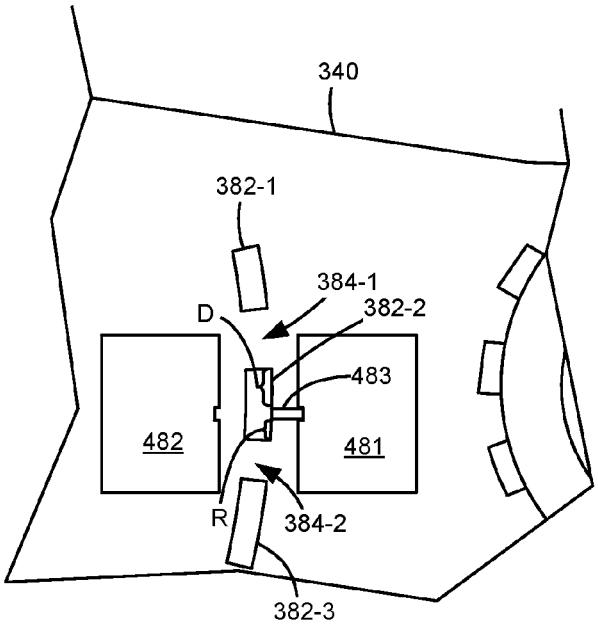

In the example illustration shown in FIGS. 14A-141 and 16, flag 380 includes first light blocking region 382-1, first light passing region 384-1, second light blocking region 382-2, second light passing region 384-2, and third light blocking region 382-3 arranged sequentially relative to a direction of motion of flag 380 with the first light blocking region 382-1 at the uppermost end of flag 380 being the first to reach index sensor 480 as flag 380 is raised from its initial position below index sensor 480, and third light blocking region 382-3 at the lowermost end thereof being the last to reach index sensor 480 relative to the upward motion of flag 380. In FIGS. 14A-141, the light blocking regions 382-1-382-3 and light passing regions 384-1, 384-2, are labeled only in FIG. 14A for purposes of clarity. The size of each of light blocking regions 382-1-382-3 and/or each light passing region 384-1, 384-2 may be determined based at least on a beam width of index sensor 480. In one example embodiment, each light blocking region 382-1-382-3 and/or a light passing region 384-1, 384-2 may be sized to have a height that at least corresponds to the sensor beam width and/or that accounts for tolerances in the media feed system and the index sensor 480 itself. For example, each light blocking region may be sized to sufficiently intercept and prevent optical energy from reaching photo-receiver 482 in order to allow detection of the light blocking region 382 by index sensor 480, while each light passing region may be sized such that sufficient amount of optical energy is allowed to pass through in order to prevent a light passing region being not detected by index sensor 480 as flag 380 moves between emitter 481 and photo-receiver 482. The light blocking and light passing regions may be of the same heights or different heights. Output signal 484 in FIG. 15 includes HIGH signal output levels corresponding to instances where the optical path 483 of index sensor 480 is unobstructed and in the first state, and LOW output signal levels corresponding to instances where the optical path is blocked by a light blocking region 382 of flag 380 and index sensor 480 is in the second state. Lift plate 172 is initially positioned at height H1 whereby media stack MS contacts pick mechanism 300 and flag 380 is raised to a position below index sensor 480 as shown in FIG. 14A. In this initial position, the output signal 484 of index sensor 480 is in the HIGH state as the optical path 483 is unblocked. In one example embodiment, for a sensor beam width of about 0.5 mm and a tolerance buffer of about ±0.2 mm, light blocking regions 382-1-382-3 and/or a light passing regions 384-1, 384-2 may each have a height of at least about 1 mm or greater, such as 2 mm. Flag 380 in one form may have an overall length of about 12 mm while each of the light blocking and light passing regions may have a height of about 2 mm.

Figure 14B:
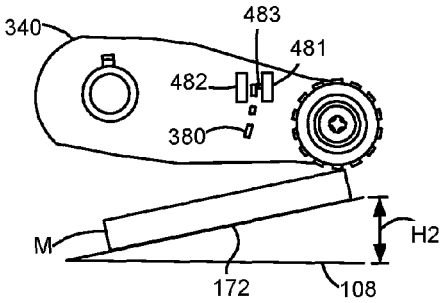
Figure 14C:
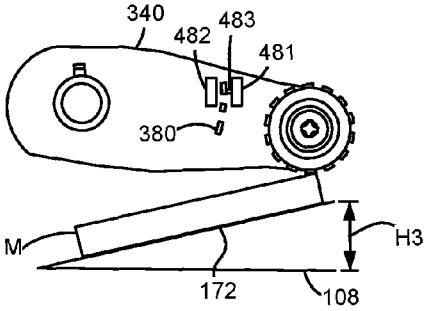
Figure 14D:
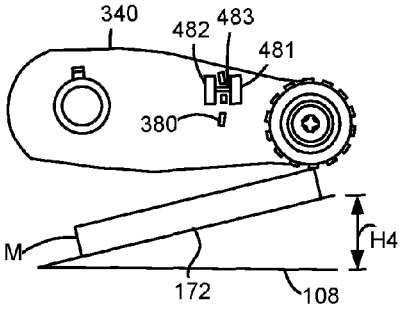
Figure 14E:
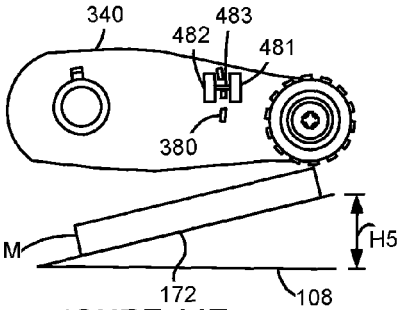
Figure 14F:
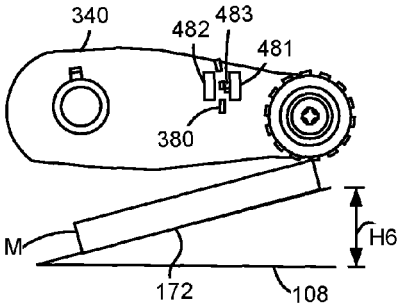
Figure 14G:
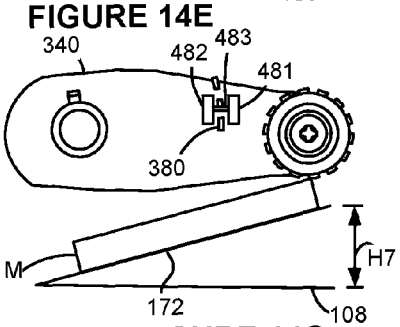
Figure 14H:
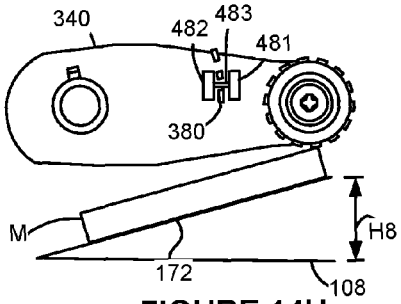
Figure 14I:
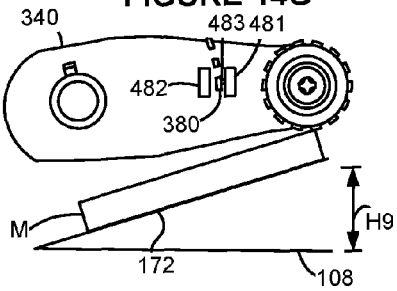

As lift plate 172 is raised to height H2 as shown in FIG. 14B, flag 380 is raised upward and first light blocking region 382-1 begins to move into and block optical path 483 which causes the output signal 484 to have a first transition 484-1 changing from the HIGH state to the LOW state. At height H3 shown in FIG. 14C, first light blocking region 382-1 continues to block the optical path 483. As lift plate 172 is raised to height H4 in FIG. 14D, first light blocking region 382-1 moves out of the optical path 483 and first light passing region 384-1 subsequently unblocks the optical path 483 causing the output signal 484 to have a second transition 484-2, changing from the LOW state to the HIGH state, following the first transition 484-1. The optical path 483 remains unblocked as lift plate 172 is raised from height H4 to height H5 as shown in FIG. 14E. In FIG. 14F, lift plate 172 is raised to height H6 moving first light passing region 384-1 out of the optical path 483 and moving second light blocking region 382-2 into and blocking the optical path 483 causing the output signal 484 to have a third transition 484-3, changing from the HIGH state to the LOW state, following the second transition 484-2. As lift plate 172 is raised further upward to height H7, as shown in FIG. 14G, second light blocking region 382-2 moves out of the optical path 483 and second light passing region 384-2 subsequently moves into and unblocks the optical path 483 causing the output signal 484 to have a fourth transition 484-4, changing from the LOW state to the HIGH state, following the third transition 484-3. The optical path 483 of index sensor 480 remains unblocked by second light passing region 384-2 as lift plate 172 is raised to height H8 as shown in FIG. 14H. The optical path 483 is subsequently blocked by third light blocking region 382-3 as lift plate 172 is further raised upward to height H9 as shown in FIG. 14I causing the output signal 484 to have a fifth transition 484-5, changing from the HIGH state to the LOW state, following the fourth transition 484-4. As will be appreciated, reverse logic to that described may also be used. For example, alternative embodiments may incorporate sensor circuitries which generate output that is in a high state when the optical path is blocked and in a low state when the optical path is unblocked.

Media may have different densities, weights, thicknesses, stiffnesses and characteristics such that the pick height required to reliably feed one type of media may be different from the pick height required to reliably feed another type of media. In one example embodiment, the multiple locations at which light blocking regions 382-1-382-3 block the optical path of index sensor 480 may be used to adjust pick mechanism 300 to different pick heights for feeding different media types. In particular, lift plate 172 can be raised to raise the media stack MS and pick mechanism 300 until a predetermined sequence of output signal 484 transitions is detected depending on the media type determined for the media in media stack MS. Accordingly, in the examples illustrated in FIGS. 14A-141 where there are three light blocking regions 382-1-382-3 and two light passing regions 384-1, 384-2 interposed between them, first light blocking region 382-1 is first to block the optical path, and, thus used to provide the lowest pick height for pick mechanism 300, and then increasing pick heights are provided for by second light blocking region 382-2 and third light blocking region 382-3. In FIG. 15, the first LOW state region LOW-1 between the first transition 484-1 and second transition 484-2 corresponds to a condition in which first light blocking region 382-1 is positioned in the optical path and height of pick mechanism 300 is within a first pick height zone, the second LOW state region LOW-2 between the third transition 484-3 and fourth transition 484-4 corresponds to a condition in which second light blocking region 382-2 is positioned in the optical path and height of pick mechanism 300 is within a second pick height zone different from (or higher than) the first pick height zone provided for by the first light blocking region 382-1, and the third LOW state region LOW-3 after the fifth transition 484-5 corresponds to a condition in which third light blocking region 382-3 is positioned in the optical path and height of pick mechanism 300 is within a third pick height zone different from (or higher than) the second pick height zone provided for by the second light blocking region 382-2.

In another example embodiment, locations at which light passing regions 384-1, 384-2 unblock the optical path of index sensor 480 may be used to adjust pick mechanism 300 to other pick heights for feeding other types of media sheets. In the example illustrated in FIGS. 14A-141, first light passing region 384-1 is used to adjust pick mechanism 300 to a pick height between the two pick heights provided for by first light blocking region 382-1 and second light blocking region 382-2, and second light passing region 384-2 is used to adjust pick mechanism 300 to a pick height between the two pick heights provided for by second light blocking region 382-2 and third light blocking region 382-3. In FIG. 15, the first HIGH state region HIGH-1 between the second transition 484-2 and third transition 484-3 corresponds to a condition in which first light passing region 384-1 is positioned in the optical path and height of pick mechanism 300 is within a pick height zone different from (or between) the pick height zones provided for by the first and second light blocking regions 382-1, 382-2, and the second HIGH state region HIGH-2 between the fourth transition 484-4 and the fifth transition 484-5 corresponds to a condition in which second light passing region 384-2 is positioned in the optical path and height of pick mechanism 300 is within a pick height zone different from (or between) the pick height zones provided for by the second and third light blocking regions 382-2, 382-3.

Different media properties and characteristics may be considered in determining a desired pick location at which pick mechanism 300 is adjusted before media is fed. The angle at which pick mechanism 300 extends from drive shaft 426 and its pick height at that angle typically provides a corresponding normal force or pressure applied by pick mechanism 300 on the topmost media sheet M of the media stack MS, and that normal force or pressure exerted by pick mechanism 300 on the media sheet M may cause different effects on the behavior of the media sheet M during feeding depending on media sheet type. For example, when compressible media, such as envelopes or labels with RFID tags, or stiffer media, such as cardstocks, are fed at a particular pick height, their behavior may differ as compared to the situation when a normal media sheet, such as copy paper or bond paper, is picked at that particular pick height. For example, compressible media, such as envelopes or labels with RFID tags, tend to compress rather than buckle and separate when picked as pick mechanism 300 continues to rotate downward about the drive shaft 426, and the normal force applied by the pick mechanism 300 to the media stack continues to increase. This compression will continue until the force required to compress the media exceeds the force required to buckle and feed the media at which point the media will buckle and feed. However, in some cases, by this point, the pick mechanism 300 will have rotated out of the desired pick zone. Furthermore, in some other cases, the compression presses the media down to pick against a vertical portion of the media dam 150 or a separator bracket thereon which can cause a failure to feed. There are also instances where the stiffness of heavy media tends to push out the tray as it hits the separator system during a pick feed operation. To aid in the picking of these media types, pick mechanism 300 may be adjusted to have higher elevated pick locations when picking these types of media. As an example, normal media may be picked at a pick height corresponding to a location at which first light blocking region 382-1 blocks the optical path of index sensor 480, envelopes may be picked at a pick height corresponding to a location at which second light blocking region 382-2 blocks the optical path of index sensor 480, and cardstocks may be picked at a pick height corresponding to a location at which third light blocking region 382-3 blocks the optical path of index sensor 480. Other examples contemplate use of first and second light passing regions 384-1, 384-2 to adjust pick mechanism 300 to higher elevated pick locations. Thus, by knowing the media type of the media stack MS, the height at which pick mechanism 300 picks and feeds media sheets M from the media stack MS can be adjusted to a desired height in correspondence to the media type by raising lift plate 172 until one of the light blocking regions 382-1-382-3 and light passing regions 384-1, 384-2, reaches the optical path of index sensor 480. In this way, pick mechanism 300 can work reliably with different types of media sheets.

In one example embodiment, after the state of index sensor 480 changes (e.g., from unblocked to blocked or vice versa) after occurrence of a respective one of the first, second, third, fourth and fifth transitions 484-1, 484-2, 484-3, 484-4 and 484-5, depending on the media type determined, pick mechanism 300 is raised a predetermined distance upward without causing index sensor 480 to change its state before pick mechanism 300 begins to pick media sheets M from the media stack MS. Areas of the light blocking regions 382-1-382-3 that obstruct the optical path of index sensor 480 define the different pick height zones for pick mechanism 300. Similarly, areas of the light passing regions 384 where the optical path of index sensor 480 is unobstructed may also define other pick height zones different from (or in between) the pick height zones defined by the areas of the light blocking regions 382.

Figure 18:
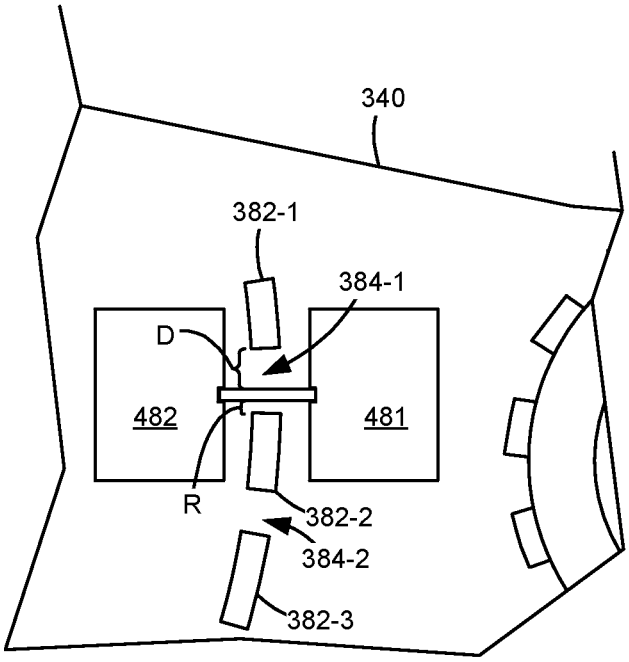
FIGS. 18-19 illustrate different positions of the pick mechanism with light passing regions of the flag unblocking the optical path of the index sensor.
Figure 19:
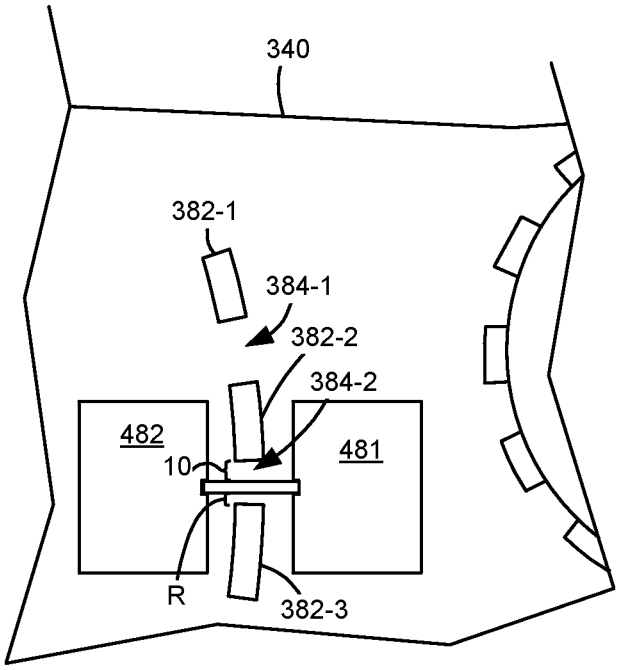

The point at which a transition occurs in the output signal 484 of index sensor 480 indicates that pick mechanism 300 has reached a lowest pick location within a given light blocking or light passing region. As pick mechanism 300 is raised, controller 3, 53 determines whether pick mechanism 300 has reached a lowest pick location of the desired light blocking or light passing region based on the output signal 484. After it is determined that pick mechanism 300 has reached a lowest pick location, motor 404 continues to rotate for a predetermined number of encoder pulses until lift plate 172 reaches a desired height in which pick mechanism 300 is raised to a predetermined level within the desired light blocking or light passing region. For example, with reference to FIG. 16, when the media type determined is a media type that requires pick mechanism 300 to be raised within the area of first light blocking region 382-1, lift plate 172 is raised upward until the first transition 484-1 occurs changing the state of index sensor from unblocked to blocked (FIG. 14B), and thereafter, lift plate 172 is continued to be raised until pick mechanism 300 has moved a predetermined distance D within the first light blocking region 382-1. Likewise, in FIG. 17 when the media type determined is one that requires pick mechanism 300 to be raised within a pick height zone defined by second light blocking region 382-2, lift plate 172 is raised upward to lift pick mechanism 300 until the third transition 484-3 occurs changing the state of index sensor 480 from blocked to unblocked (FIG. 14E), and thereafter, lift plate 172 is continued to be raised until pick mechanism 300 has moved a predetermined distance D within the second light blocking region 382-2. In FIGS. 18-19 illustrating embodiments where light passing regions 384-1, 384-2 are respectively used to adjust pick height, lift plate 172 is raised upward to lift pick mechanism 300 until pick mechanism 300 has moved a predetermined distance D within the first and second light passing region 384-1, 384-2, respectively, after occurrence of the second transition 484-1 or the fourth transition 484-4, respectively. In one example embodiment, distance D may be greater than 1 mm, such as about 1.3 mm. In FIGS. 16-19 the region R below the traveled predetermined distance D within a light blocking region or a light passing region may be provided to compensate for system tolerances. In one example embodiment, this region R may be minimized to allow for smaller stack height changes between pick zones.

Once lift plate 172 reaches the desired height in which pick mechanism 300 is at a predetermined distance D within a desired light blocking or light passing region, pick mechanism 300 is then ready to feed media in the media process direction. As a media sheet M is fed, the height of the media stack MS decreases thereby lowering the position of pick mechanism 300. Eventually, pick mechanism 300 lowers far enough for index flag 380 to change the state of index sensor 480 (e.g., from blocked to unblocked or vice versa), thereby signaling that another indexing move is required. Motor 404 once again rotates for the predetermined number of encoder pulses until lift plate 172 reaches the desired height in which pick mechanism 300 is raised again to the predetermined level D within the desired light blocking or light passing region. The indexing moves that occur as a result of the reduction in the height of the media stack MS due to media being fed are referred to as nominal raises or nominal index moves. As media continues to be fed, nominal index moves are repeated to ensure that the pick mechanism 300 stays within the desired light blocking or light passing region until all of the media sheets M in media input tray 100 needed for a given print job are fed to IFD 2.

Each time media input tray 100 is removed from the housing 20, drive transmission 401 disconnects from the second output 401C causing the lift plate 172 to fall to bottom 108 of media input 100. In the example embodiment shown, when media input tray 100 is removed, second clutched gear 416 and intermediary gear 418 in the side wall 104*a* are decoupled. As a result, each time media input tray 100 is reinserted into housing 20, 60 lift plate 172 must be indexed from bottom 108 of media input tray 100 until pick mechanism 300 reaches a desired pick location. When IFD 2 is turned off, lift plate 172 remains in the same position unless media input tray 100 is removed. Therefore, when IFD 2 is powered back on, pick mechanism 300 continues to pick in the same pick zone as before the power-off cycle.

In the example embodiments where light passing regions 384-1, 384-2 of flag 380 are used to adjust the pick height, an issue may arise when pick mechanism 300 is in one of the light passing regions 384-1, 384-2 and IFD 2 is turned off. When IFD 2 is powered back on, the output signal of index sensor 480 may no longer be indicative of the position of pick mechanism 300. First, removal of media input tray 100 while IFD 2 is turned off causes lift plate 172 to fall to the bottom 108, and when IFD 2 is powered back on, flag 380 is returned to its starting position below index sensor 480 and index sensor is in the unblocked state. Second, if removable media input tray 100 is not removed while IFD 2 is turned off, lift plate 172 and pick mechanism 300 remain in the same position when IFD 2 is turned back on such that the light passing region 384-1, 384-2, as the case may be, remains positioned in the optical path and index sensor 480 is in the unblocked state. In order for controller 3, 53 to determine whether the unblocked state of index sensor 480 is due to flag 380 being in a position below index sensor 480 caused by removal of media input tray 100 while IFD 2 is turned off, or due to being in a light passing region 384-1 or 384-2, a lift plate sensor for sensing position of the lift plate 172 may be used. Referring back to FIG. 13, media input tray 100 includes a lift plate sensor 250 for sensing whether or not lift plate 172 has fallen to the bottom 108. In the example embodiment illustrated, lift plate 172 includes a flag 177 extending from the bottom 172*a* thereof and lift plate sensor 250 is an optical sensor having an optical path between a pair of opposed arms 252 that are spaced to allow flag 177 to be positioned therebetween and block the optical path when lift plate 172 falls to the bottom 108. When IFD 2 is powered back on, also referred to as a power-on reset or POR, controller 3, 53 determines whether lift plate 172 has fallen to the bottom 108 based on the status of lift plate sensor 250. If lift plate sensor 250 is blocked by flag 177, this indicates that media tray 100 was removed while IFD 2 was turned off and lift plate 172 has fallen to the bottom 108. Accordingly, lift plate 172 is indexed from bottom 108 of media tray 100 until pick mechanism 300 reaches a desired pick location. If lift plate sensor 250 is unblocked by flag 177 when IFD 2 is turned on, this indicates that media tray 100 was not removed while IFD 2 was turned off, and lift plate 172 and pick mechanism 300 are retained in the same position as before the power-off cycle.

Figure 20:
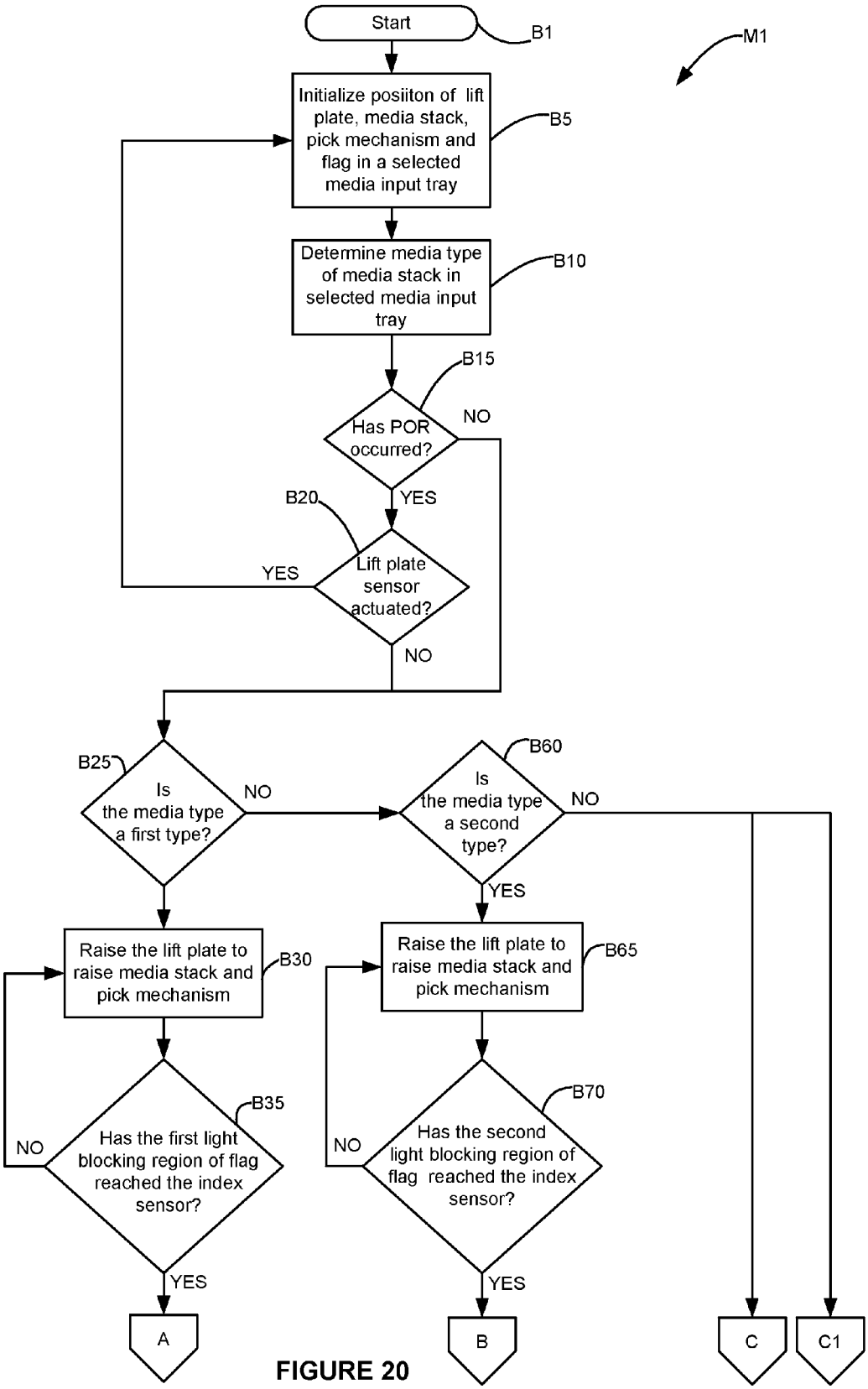
FIGS. 20-22 illustrate a flowchart of a method for adjusting the pick height of the pick mechanism based on media type.
Figure 21:
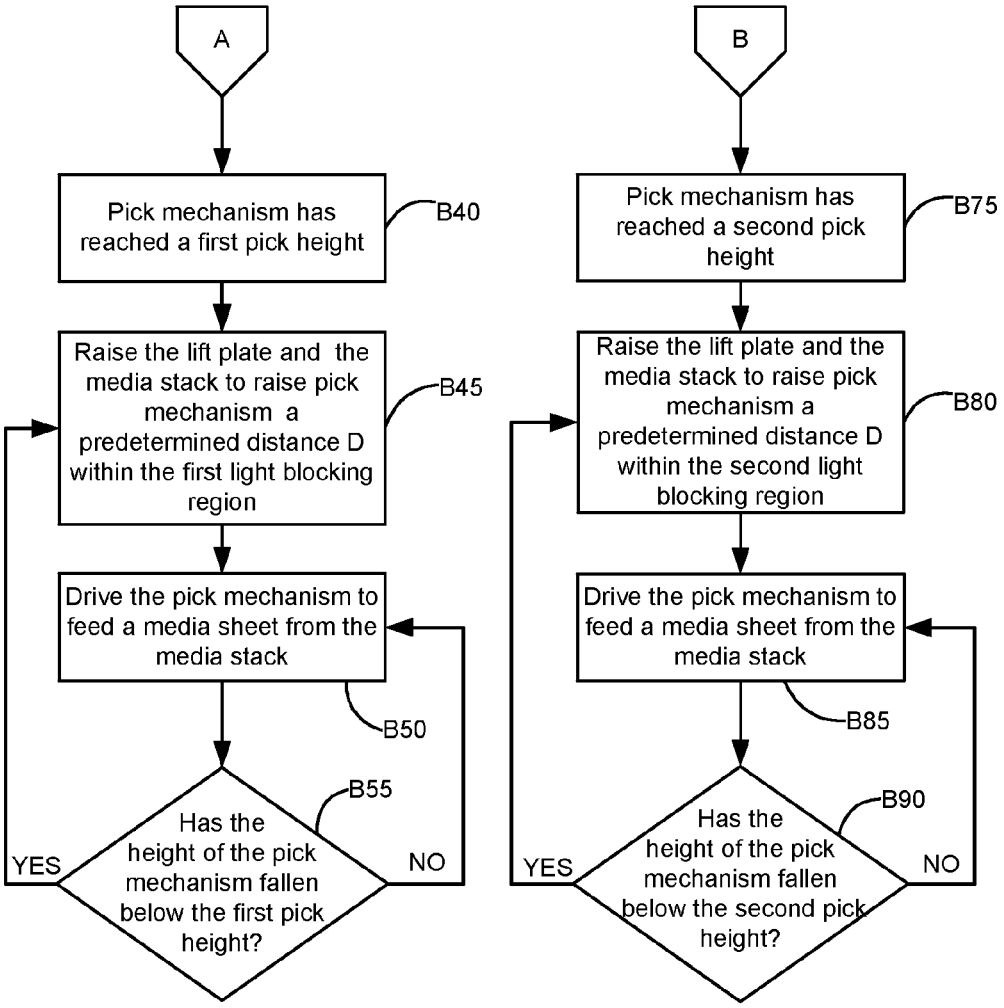
Figure 22:
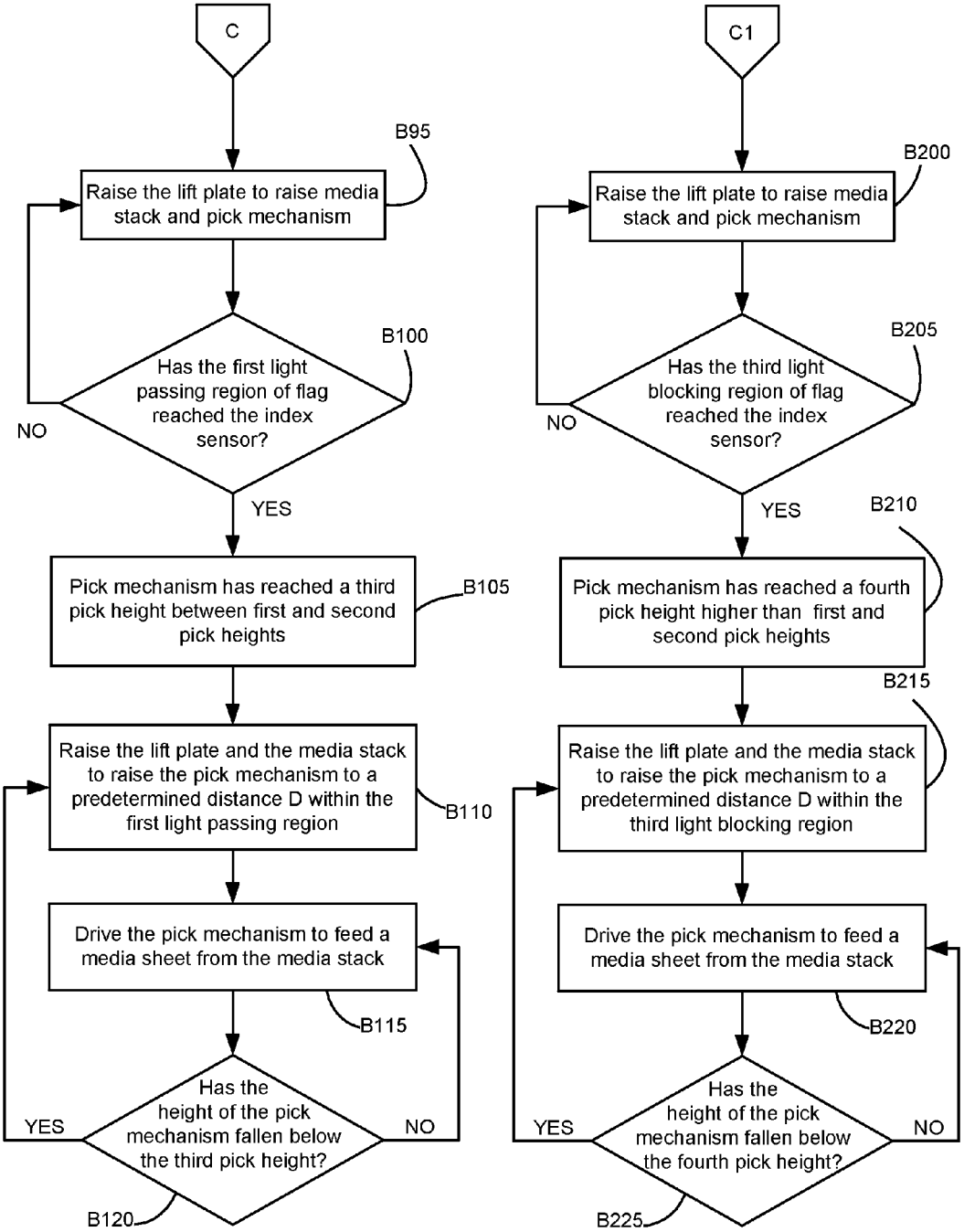

For the methods described herein, reference is made to FIGS. 20-22 illustrating a block diagram of a method M1 for adjusting the pick height of pick mechanism 300 based on media type. Method M1 begins at start block B1. At block B5, the lift plate 172, media stack MS, pick mechanism 300 and flag 380 are brought to a predetermined initialized position in a selected media input tray 100. Controller 3 or user-input provided to controller 3 may be used to select which media input tray 100 to use. In the selected media input tray 100, a media stack MS having one or more media sheets M to be fed into IFD 2 is supported on lift plate 172 which is lifted by drive assembly 400 a predetermined number of indexed moves so that pick mechanism 300 is brought into contact with a topmost media sheet M of the media stack MS and flag 380 is initially positioned below index sensor 480 such that the output signal of index sensor 480 is in the first state. As used in the following descriptions, the first state corresponds to an unblocked state of index sensor 480 while the second state corresponds to a blocked state thereof. At block B10, controller 3, 53 determines the type of media on lift plate 172 in the selected media input tray 100. The media type may be indicated by a user, for example, at user interface 7 or at a peripheral device. Alternatives include those wherein the controller 3, 53 determines the media type based on readings from media type sensor 230.

At block B15 a determination is made whether or not a power-on-reset (POR) has occurred. When it is determined that a POR has not occurred method M1 proceeds to block B25. When it is determined that a POR has occurred, method M1 proceeds to block B20 where a determination is made whether or not the lift plate sensor 250 has been actuated by flag 177 on lift plate 172 due to the lift plate 172 dropping to the bottom 108 of media input tray 100 because media input tray 100 has been removed. When it has been determined that lift plate sensor 250 has been actuated, method M1 loops back to block 5, to reinitialize the system. When it has been determined that the lift plate sensor has not been actuated, method M1 proceeds to block B25.

At block B25, a determination is made as to whether or not the determined media type is a first media type. When it is determined that the media type is a first media type, method M1 proceeds to block B30 to raise lift plate 172 to raise the media stack and pick mechanism 300. At block B35, a determination is made as to whether or not the first light blocking region 382-1 has actuated index sensor 480 by blocking the optical path thereof and causing the sensor output signal to have the first transition 484-1 changing from the first state to a second state. On determining that the first transition 484-1 has not occurred, method M1 loops back to block B30 to continue with the raising of lift plate 172. When it is determined, at block B35, that the first transition 484-1 has occurred indicating that first light blocking region 382-1 has reached and blocked the optical path, then at block B40, the pick mechanism 300 has reached a first pick height. Method M1 then proceeds to block B45 to raise lift plate 172 and the media stack to raise pick mechanism 300 a predetermined distance D within the first light blocking region 382-1 and without causing first light blocking region 382-1 to move out of the optical path and the sensor output signal to change state. For example, lift plate continues to raise approximately 1.3 mm. At block B50, controller 3, 53 controls motor 404 to drive pick mechanism 300 to feed a media sheet M of the first media type from the media stack MS.

Between each pick of the media sheet M, controller 3, 53 determines whether or not the height of pick mechanism 300 has fallen below the first pick height at block B55, for example by determining whether first light blocking region 382-1 has fallen below and moved out of the optical path of index sensor 480 causing the output signal thereof to change from the second state to the first state due to the decrease in media stack height. On determining that pick mechanism 300 has not fallen below the first pick height, method M1 loops back to block B50 to proceed with the feeding of a next media sheet M. When it is determined, at block B55 that pick mechanism has fallen below the first pick height, method M1 loops back to block B45 to raise lift plate 172 and the media stack MS to raise pick mechanism 300 back to the predetermined distance D within the first light blocking region. The method M1 continues until all of the media sheets of the designated media type for a given print job have been printed.

When it is determined, at block B25, that that the determined media type is not a first media type, method M1 proceeds to block B60 to determine whether or not the determined media type is a second media type different from the first media type. When it is determined that the determined media type is the second media type, method M1 proceeds to block B65 to raise lift plate 172 to raise the media stack and pick mechanism 300. At block B70, a determination is made as to whether or not the second light blocking region 382-1 has reached and blocked the optical path of index sensor 480 causing the sensor output signal to have the third transition 484-3 (change from first state to second state) following the second transition 484-2 (change from second state to first state) which in turn follows the first transition 484-1. On determining that the second light blocking region has not reached the index sensor 480 (i.e., third transition 484-3 has not occurred), method M1 loops back to block B65 to continue raising the lift plate 172. When it is determined, at block B70, that the second light blocking region has reached the index sensor 480 (i.e., third transition 484-3 has occurred), then at block B75, controller 3 recognizes that the pick mechanism 300 has reached a second pick height different from (or higher than) the first pick height. Method M1 then proceeds to block B80 to raise lift plate 172 and the media stack a predetermined distance D to raise pick mechanism 300 to a predetermined level within the second light blocking region 382-2 and without causing second light blocking region 382-2 to move out of the optical path and the sensor output signal to change from the second state to the first state. At block B85, controller 3, 53 controls motor 404 to drive pick mechanism 300 to feed a media sheet M of the second media from the media stack MS in the selected media input tray 100.

Between each pick, controller 3, 53 determines whether or not the height of pick mechanism 300 has fallen below the second pick height at block B90, for example by determining whether second light blocking region 382-2 has fallen below and moved out of the optical path of index sensor 480 and the first light passing region 384-1 has reentered the optical path of index sensor 480 causing the output signal thereof to change from the second state to the first state due to the decrease in media stack height. On determining that pick mechanism 300 has not fallen below the second pick height, method M1 loops back to block B80 to proceed with the feeding of the next media sheet. When it is determined, at block B90, that pick mechanism 300 has fallen below the second pick height, method M1 loops back to block B80 to raise lift plate 172 and the media stack the predetermined distance D to raise pick mechanism 300 back to the predetermined level within the second light blocking region. Again, the method M1 continues until all of the media sheets of the designated media type for a given print job have been printed.

It should be noted that blocks B45 and B80 do not need to be performed when feeding the media sheet.

As discussed above, other example embodiments contemplate use of light passing regions 384-1, 384-2 to adjust the height of pick mechanism 300 based on media type. In one example embodiment, when it is determined, at block B60, that that the determined media type is not a second media type, then the determined media type is a third media type different from the second media type. Method M1 then proceeds to block B95 to raise lift plate 172 to raise the media stack and pick mechanism 300. At block B100, a determination is made as to whether or not the first light passing region 384-1 has reached and unblocked the optical path of index sensor 480 causing the sensor output signal to have the second transition 484-2 (change from second state to first state) following the first transition 484-1. On determining that the second transition 484-2 has not occurred, method M1 loops back to block B95 to continue with the raising of lift plate 172. When it is determined, at block B100, that the second transition 484-2 has occurred indicating that first light passing region 384-2 has reached and unblocked the optical path, it is recognized, at block B105, that the pick mechanism 300 has reached a third pick height between the first and second pick heights. Method M1 then proceeds to block B110 to raise lift plate 172 and the media stack a predetermined distance D to raise pick mechanism 300 to a predetermined level within the first light passing region 384-1 and without causing first light passing region 384-1 to move out of the optical path and the sensor output signal to change from the first state to the second state. At block B115, controller 3, 53 controls motor 404 to drive pick mechanism 300 to feed a media sheet of the third media type from the media stack.

Between each pick, controller 3, 53 determines whether or not the height of pick mechanism 300 has fallen below the third pick height at block B120, for example by determining whether first light passing region 384-1 has fallen below and moved out of the optical path of index sensor 480 causing the output signal thereof to change from the first state to the second state due to the decrease in media stack height. On determining that pick mechanism 300 has not fallen below the third pick height, method M1 loops back to block B115 to proceed with the feeding of the next media sheet M of the third media type. When it is determined, at block B120, that pick mechanism 300 has fallen below the third pick height, method M1 loops back to block B110 to raise lift plate 172 and the media stack the predetermined distance D to raise pick mechanism 300 back to the predetermined level within the third pick zone.

Although the example method M1 has been described with three different pick heights at which pick mechanism 300 can be raised depending on media type, it is understood that pick mechanism 300 may be raised to any number of different pick heights by providing additional light blocking regions and light passing regions in flag 380. For example, after is it determined at block B60 that the media type is not a second media type but rather another media type, method M1 may, in the alternative, proceed to block B200 to raise lift plate 172 to raise the media stack and pick mechanism 300. At block B205, a determination is made as to whether or not a third light blocking region 382-3 has reached and blocked the optical path of index sensor 480 causing the index sensor output signal to change from first state to the second state following the fifth transition 484-5. On determining that the fifth transition 484-5 has not occurred, method M1 loops back to block B200 to continue with the raising of lift plate 172. When it is determined, at block B205, that the third light blocking region 384-3 has been reached and blocked the optical path (i.e., the fifth transition 484-5 has occurred), it is recognized, at block B210, that the pick mechanism 300 has reached a fourth pick height greater than the first, second and third pick heights. Method M1 then proceeds to block B215 to raise lift plate 172 and the media stack a predetermined distance D to raise pick mechanism 300 to a predetermined level within the third light blocking region 384-3 and without causing the third light blocking region 382-3 to move out of the optical path and the sensor output signal 484 to change from the second state to the first state. At block B220, controller 3, 53 controls motor 404 to drive pick mechanism 300 to feed a media sheet of the another media type from the media stack.

Between each pick, controller 3, 53 determines whether or not the height of pick mechanism 300 has fallen below the fourth pick height at block B225, for example by determining whether the third light blocking region 384-3 has fallen below and moved out of the optical path of index sensor 480 causing the output signal 484 thereof to change from the second state to the first state due to the decrease in media stack height. On determining that pick mechanism 300 has not fallen below the fourth pick height, method M1 loops back to block B220 to proceed with the feeding of the next media sheet M of the another media type. When it is determined, at block B225, that pick mechanism 300 has fallen below the fourth pick height, method M1 loops back to block B215 to raise lift plate 172 and the media stack the predetermined distance D to raise pick mechanism 300 back to the predetermined level within the third pick zone.

Again blocks B110, B215 need not be performed. Further, the process followed in blocks B100-B120 for the first light passing region 484-1 to establish the third pick height may be followed as applied to the second light passing region 484-2 to provide a fifth pick height that is less than the fourth pick height and greater than the second pick height.

As discussed above, lift plate 172 is raised in indexed moves. Motor 404 raises lift plate 172 until one of the light blocking regions 382-1-382-3 and/or light passing regions 384-1, 384-2 of index flag 380 of pick mechanism 300 changes the state of index sensor 480 and its output signal 484, depending on media type. This signals that pick mechanism 300 has reached a lowest pick location of with the desired light blocking or light passing region corresponding to the media type determined. Lift plate 172 continues to be raised a predetermined distance D above the lowest pick point to raise pick mechanism 300 within a predetermined level within the desired light blocking or light passing region. As media sheets M are fed from media stack MS, pick mechanism 300 moves downward to a point just beneath the lowest pick point where the flag 380 changes the state of index sensor 480 as the corresponding light blocking/passing region of flag 380 falls below the optical path. This signals controller 3, 53 to again index lift plate 172 upward to the predetermined distance D above the lowest pick point. For the example 1.3 mm index move previously described, the rotation movement of pick mechanism 300 is in an essentially linear motion, meaning that there is only a minute variance in the pick location of the topmost sheet. Lift plate 172 is raised periodically in an indexed move each time a light blocking region or light passing region of index flag 380 drops below index sensor 480.

It should also be noted that the predetermined distance D that the lift plate is raised within a given light blocking or light passing region can be the same as or can be different from the predetermined distance used in another of the light blocking or light passing regions.

The foregoing description of several methods and an embodiment of the present disclosure have been presented for purposes of illustration. It is not intended to be exhaustive or to limit the present disclosure to the precise steps and/or forms disclosed, and obviously many modifications and variations are possible in light of the above description. It is intended that the scope of the present disclosure be defined by the claims appended hereto.

What is claimed is:

1. A media feeding system for an image forming device (IFD), the media feeding system comprising:

an input media tray having a bottom with a raisable lift plate for holding a media stack having at least one media sheet;

a pick mechanism rotatably coupled to a drive assembly for feeding a topmost media sheet of the media stack, the pick mechanism having a flag having a first and a second light blocking region, and a first light passing region therebetween;

an optical sensor mounted adjacent the input media tray, the optical sensor including an emitter and a photo-receiver spaced to allow the flag to pass therebetween and providing an output signal that changes between a first state and a second state as the flag passes between the emitter and the photo-receiver, the output signal representative of a position of the pick mechanism that changes as the height of the stack changes;

a lift mechanism operably coupled to the lift plate for raising the lift plate;

a lift plate sensor that is actuated when the lift plate is positioned on the bottom;

and, a controller operably coupled to the optical sensor, the lift plate sensor, the drive assembly and the lift mechanism, the controller configured to:

control the lift mechanism to initialize the lift plate to a height in which the flag is positioned below the optical sensor and the output signal of the optical sensor is in the first state;

determine a media type for the media stack on the lift plate;

when the media type determined is a first media type, control the lift mechanism to raise the lift plate to raise the media stack and the pick mechanism until the first light blocking region is positioned between the emitter and the photo-receiver changing the output signal from the first state to the second state indicating that the pick mechanism has reached a first pick height;

when the media type determined is a second media type, control the lift mechanism to raise the lift plate to raise the media stack and the pick mechanism until the second light blocking region is positioned between the emitter and the photo-receiver changing the output signal from the first state to the second state back to the first state and then back to the second state indicating that the pick mechanism has reached a second pick height different from the first pick height; and, feed one of the first media type and the second media type and determine after a power on reset whether or not the lift plate sensor is actuated, and, when it is determined that the lift plate sensor has not been actuated, continue to feed the one of the first media type media sheet and the second media type media sheet.

2. The media feeding system of claim 1, wherein the first light passing region is defined by a slot formed between the first and second light blocking regions.

3. The media feeding system of claim 1, wherein the first light passing region comprises a substantially transparent section of the flag between the first and second light blocking regions.

4. The media feeding system of claim 1, wherein when the media type determined is a third media type, the controller is configured to control the lift mechanism to raise the lift plate to raise the media stack and the pick mechanism until the first light passing region is positioned between the emitter and the photo-receiver changing the output signal from the first state to the second state and then back to the first state indicating that the pick mechanism has a reached a third pick height between the first and second pick heights.

5. The media feeding system of claim 1, wherein the flag further includes a second light passing region following the second light blocking region, and a third light blocking region following the second light passing region, the controller further configured to:

when the media type determined is another media type different from the first and second media types, control the lift mechanism to raise the lift plate to raise the media stack and the pick mechanism until the third light blocking region is positioned between the emitter and the photo-receiver changing the output signal from the first state to the second state back to the first state then back to the second state then back to the first state and then back to the second state indicating that the pick mechanism has reached another pick height different from the first and second pick heights.

6. The media feeding device of claim 1, wherein the controller is further configured to:

when it is determined that the lift plate sensor has been actuated after a power on reset:

raise the lift plate and media stack to move the pick mechanism to reposition the flag below the index sensor with the output signal of the index sensor being in a first state; and, redetermine the media type for the media stack.

7. In an image forming device (IFD) having a media input tray having a bottom with a raisable lift plate mounted thereon, a drive mechanism for raising the lift plate from the bottom, a flag-actuated index sensor mounted a predetermined height above the bottom, a lift plate sensor that is actuated when the lift plate is positioned on the bottom, a pick mechanism having a flag thereon, and a controller in operable communication with the drive mechanism, the index sensor, the lift plate sensor, and the pick mechanism, a method for adjusting a pick height of the pick mechanism comprising:

supporting on the lift plate a media stack having one or more media sheets to be fed into the IFD with the pick mechanism being in contact with a topmost media sheet of the media stack and the flag being initially positioned below the index sensor with an output signal of the index sensor being in a first state;

determining a media type for the media stack;

when the media type determined is a first media type:

raising the lift plate to raise the media stack and the pick mechanism until the index sensor is actuated by the flag causing the output signal to have a first transition from the first state to a second state, the first transition indicating that the pick mechanism has a reached a first pick height; and, feeding one or more media sheets of the first media type using the pick mechanism;

and, when the media type determined is a second media type:

raising the lift plate to raise the media stack and the pick mechanism until the output signal of the index sensor has the first transition followed by a second transition followed by a third transition, the second transition being from the second state to the first state, and the third transition being from the first state to the second state, the third transition indicating that the pick mechanism has reached a second pick height different from the first pick height; and, feeding one or more media sheets of the second media type using the pick mechanism; and, when feeding one of the first media type and the second media type, determining after a power on reset whether or not the lift plate sensor is actuated, and, when it is determined that the lift plate sensor has not been actuated, continuing to feed one of the first media type media sheet and the second media type media sheet, wherein a first and a second light blocking region separated by a light passing region therebetween in the flag causing the first, second and third transitions of the output signal between the first and second states as the flag moves through the index sensor.

8. The method of claim 7, further comprising:

when the media type determined is the first media type and after the occurrence of the first transition, raising the lift plate to raise the media stack and the pick mechanism a predetermined distance without causing the index sensor output signal to change from the second state to the first state, then after the pick mechanism is raised the predetermined distance and as the one or more media sheets from the media stack is fed by the pick mechanism, determining, whether or not the height of the pick mechanism has fallen below the first pick height based on whether or not the index sensor output signal has changed state, and, upon determining that the height of the pick mechanism has fallen below the first pick height, raising the lift plate to raise a remainder of media stack and the pick mechanism the predetermined distance;

and, when the media type determined is the second media type and after the occurrence of the third transition, raising the lift plate to raise the media stack and the pick mechanism a predetermined distance without causing the index sensor output signal to change from the second state to the first state, then after the pick mechanism is raised the predetermined distance and as the one or more media sheets from the media stack is fed by the pick mechanism, determining, whether or not the height of the pick mechanism has fallen below the second pick height based on whether or not the index sensor output signal has changed state, and, upon determining that the height of the pick mechanism has fallen below the second pick height, raising the lift plate to raise a remainder of media stack and the pick mechanism the predetermined distance.

9. The method of claim 7, further comprising when the media type determined is a third media type:

raising the lift plate to raise the media stack and the pick mechanism until the output signal of the index sensor has the first and the second transitions, the second transition indicating that the pick mechanism has a reached a third pick height between the first and second pick heights; and, feeding one or more media sheets of the third media type using the pick mechanism.

10. The method of claim 9, further comprising, after the occurrence of the second transition, raising the lift plate to raise the media stack and the pick mechanism a predetermined distance without causing the sensor output signal to change from the second state to the first state.

11. The method of claim 7, wherein the method further comprises:

when it is determined that the lift plate sensor has been actuated:

raising the lift plate and media stack to move the pick mechanism to reposition the flag below the index sensor with the output signal of the index sensor being in a first state; and, redetermining the media type for the media stack.

12. The method of claim 7, further comprising:

when the media type determined is another media type different from the first and second media types:

raising the lift plate to raise the media stack and the pick mechanism until the output signal of the index sensor has the first transition followed by the second transition followed by the third transition followed by a fourth transition followed by a fifth transition, the fourth transition being from the second state to the first state, and the fifth transition being form the first state to the second state, the fifth transition indicating that the pick mechanism has reached another pick height greater than the first and second pick heights; and, feeding one or more media sheets of the another media type using the pick mechanism, wherein a third blocking region is separated from the second light blocking region by a second light passing region therebetween in the flag causing the first through fifth transitions of the output signal as the flag moves through the index sensor.

13. The method of claim 12, further comprising, after the occurrence of the fifth transition, raising the lift plate to raise the media stack and the pick mechanism a predetermined distance without causing the index sensor output signal to change from the second state to the first state.

* * * * *